US009080379B2

(12) United States Patent
Guillemette

(10) Patent No.: US 9,080,379 B2
(45) Date of Patent: Jul. 14, 2015

(54) WINDOW ASSEMBLY

(75) Inventor: Christian Guillemette, Beauport (CA)

(73) Assignee: 9163-9047 QUÉBEC INC., Québec, QC (CA)

( * ) Notice: Subject to any disclaimer, the term of this patent is extended or adjusted under 35 U.S.C. 154(b) by 202 days.

(21) Appl. No.: 13/297,406

(22) Filed: Nov. 16, 2011

(65) Prior Publication Data

US 2012/0117882 A1 May 17, 2012

Related U.S. Application Data

(60) Provisional application No. 61/414,218, filed on Nov. 16, 2010.

(51) Int. Cl.

| | |
|---|---|
| ***E06B 3/48*** | (2006.01) |
| ***E06B 3/50*** | (2006.01) |
| ***E05D 15/26*** | (2006.01) |

(52) U.S. Cl.

CPC ..... *E06B 3/5018* (2013.01); *E05D 15/262* (2013.01); *E05D 15/264* (2013.01); *E06B 3/483* (2013.01)

(58) Field of Classification Search

CPC ..... E05D 15/262; E05D 15/264
USPC ..... 49/176, 181, 188, 189; 160/187, 89
See application file for complete search history.

(56) References Cited

U.S. PATENT DOCUMENTS

| | | | | | |
|---|---|---|---|---|---|
| 1,387,479 | A | * | 8/1921 | Dutcher | 160/187 |
| 1,757,048 | A | * | 5/1930 | Janeczko | 160/207 |
| 2,330,696 | A | * | 9/1943 | Exiner | 160/187 |
| 2,408,739 | A | * | 10/1946 | Dawes | 160/188 |
| 2,613,738 | A | * | 10/1952 | Bowman | 160/11 |
| 2,637,381 | A | * | 5/1953 | Bowman | 160/40 |
| 2,771,133 | A | * | 11/1956 | Haskell | 160/89 |
| 2,879,841 | A | * | 3/1959 | Etten | 160/96 |
| 3,493,033 | A | * | 2/1970 | McGirr | 160/207 |
| 4,039,018 | A | * | 8/1977 | De Maria | 160/89 |
| 4,332,287 | A | * | 6/1982 | Stolpe | 160/133 |
| 4,637,446 | A | * | 1/1987 | McQueen et al. | 160/207 |
| 4,663,904 | A | * | 5/1987 | Glenn | 52/202 |
| 4,922,987 | A | * | 5/1990 | Marontate et al. | 160/183 |
| 4,924,932 | A | * | 5/1990 | Esnault | 160/201 |
| 5,228,240 | A | * | 7/1993 | Barroero et al. | 49/386 |
| 5,363,898 | A | * | 11/1994 | Sprague | 160/98 |
| 5,372,175 | A | * | 12/1994 | Calhoun et al. | 160/235 |
| 5,472,037 | A | * | 12/1995 | Hoffman | 160/183 |

(Continued)

OTHER PUBLICATIONS http://www.baumgartnerfenster.ch/fileadmin/pdfs/produktbroschueren_de/08_Faltschieber.pdf.

*Primary Examiner* — Katherine Mitchell
*Assistant Examiner* — Johnnie A Shablack
(74) *Attorney, Agent, or Firm* — Fasken Martineau DuMoulin

(57) ABSTRACT

A window assembly comprising an upright window frame defining a frame opening, and an upper sash and a lower sash mounted in the window frame. The frame of the upper sash has its top corners pivotally mounted to the window frame. The frame of the lower sash has its bottom corners pivotally mounted to the window frame. The bottom rail of the upper sash is hingedly connected to the bottom rail of the upper sash. At least one of the upper and lower sashes is also slidably mounted to the frame jambs of the window frame, allowing the slidable sash to slide vertically within the window frame. The upper and lower sashes are movable between an extended closed configuration and a folded open configuration.

16 Claims, 25 Drawing Sheets

(56) References Cited

U.S. PATENT DOCUMENTS

| | | | | | |
|---|---|---|---|---|---|
| 5,601,131 | A * | 2/1997 | Morris | 160/207 |
| 5,664,769 | A * | 9/1997 | Sadinsky et al. | 256/73 |
| 5,687,509 | A * | 11/1997 | Barroero et al. | 49/386 |
| 6,041,847 | A * | 3/2000 | Lai | 160/236 |
| 6,056,037 | A * | 5/2000 | Jonkman et al. | 160/207 |
| 6,095,225 | A * | 8/2000 | Miller | 160/133 |
| 6,161,605 | A * | 12/2000 | Pena | 160/90 |
| 7,290,581 | B2 * | 11/2007 | Lee | 160/183 |
| 2008/0060274 | A1 * | 3/2008 | Vooght | 49/394 |
| 2009/0321023 | A1 * | 12/2009 | Curry, III | 160/133 |
| 2010/0180505 | A1 * | 7/2010 | Sordo et al. | 49/70 |
| 2010/0282418 | A1 * | 11/2010 | Lucas | 160/54 |
| 2012/0144743 | A1 * | 6/2012 | Piney | 49/29 |
| 2013/0213586 | A1 * | 8/2013 | Lucas | 160/54 |
| 2013/0292067 | A1 * | 11/2013 | Lucas | 160/213 |
| 2013/0319623 | A1 * | 12/2013 | Crown et al. | 160/224 |

* cited by examiner

WINDOW ASSEMBLY

CROSS-REFERENCE TO RELATED APPLICATIONS

This Application claims priority under 35 U.S.C. §119(e) to U.S. Provisional Patent Application No. 61/414,218, filed Nov. 16, 2010, entitled "WINDOW ASSEMBLY", which is herein incorporated by reference in its entirety.

FIELD OF THE INVENTION

The present invention relates to the field of windows and window frames. More particularly, it concerns an upright window having an upper sash and a lower sash.

BACKGROUND

Single-hung and double-hung windows are the most prevalent types of windows in North America. They have a sought-after traditional appearance and operate by sliding upper and lower window sashes up and down within a window frame. Two main advantages of double-hung windows are their easiness of operation and their traditional style.

While they offer a pleasing traditional aesthetic look, double-hung windows have two main disadvantages: they are not as airtight as other windows and they have limited ventilation. Insulating strips, also called weather strips in double-hung windows are usually located within the lateral sides of the frame of the sashes or in lateral channels of the outer window frame. In other types of windows having better insulating properties, such as casement windows, the weather strips are usually placed between the window frame and the sash frames such that when wind blows upon the window, the weather strips are compressed between the sash frames and the window frame, providing better insulation.

Now with regard to ventilation, double-hung windows work by sliding the top sash down or the bottom sash up. This means that only half of the window remains open at one time. Some types of awning windows offer the look of double-hung window by having an upper panel fixed above a mullion and a lower panel which can be pivoted horizontally about its lower rail, within the lower portion of the window frame. However, such type of window also requires that one of the sashes stays closed while the other one is open. In addition, the degree of aperture of the pivoting window is limited. Such windows also often require cranks and complex hinge assemblies to maintain the window opened. The evermore stringent requirements for windows with better insulating properties have forced windows manufacturers to offer double and even triple thermal insulation windows. In other words, each window sash or window panel includes two or three glass panels retained within the frame of a sash. The weight of each window sash is thus considerably increased. Stronger and more complex counter-weight devices must be used with these types of thermally insulated window panels, especially with double-hung windows, in order to remain easy to open.

There is a need for a window assembly having the pleasing traditional aesthetic look of a double-hung window while offering better insulating properties, and increased ventilation. There is also a need for a window assembly which can accommodate two or three glass panels per window frame, while remaining easy to open, without requiring expensive or complex balance devices. Of course, it would be desirable for this window assembly to present an aesthetic, lean and simple design from inside as well as from outside the building.

SUMMARY OF THE INVENTION

Various embodiments provide a window assembly that satisfies at least one of the above-mentioned needs.

The window assembly includes an upright window frame which defines a frame opening. The window frame has a frame header, a frame sill, and a pair of vertical frame jambs extending from the frame header to the frame sill.

The window assembly also includes an upper sash and a lower sash mounted in the window frame. Each of the sashes has a sash frame and a panel. Each sash frame includes a top rail, a bottom rail and two vertical stiles extending from the top to the bottom rail, for retaining the panel. The frame of the upper sash has a top section and a bottom section. The top section is pivotally mounted to the window frame, allowing the upper sash to pivot about its top rail. The frame of the lower sash also has a top section and a bottom section. The bottom section is pivotally mounted to the window frame, allowing the bottom sash to pivot about its bottom rail. At least one of the upper and lower sashes is a slidable sash. The frame of the slidable sash is also slidably mounted to the frame jambs of the window frame, allowing the slidable sash to slide vertically within the window frame.

The window assembly also includes a hinge assembly for hingedly connecting the frame bottom section of the upper sash with the frame top section of the lower sash.

The upper and lower sashes are movable between an extended closed configuration and an open folded configuration. In the extended closed configuration, the upper and lower sashes extend within the window frame, closing the frame opening. In the folded open configuration, the slidable sash is brought towards the other sash and the hinge assembly points outwardly from the window frame.

The window assembly also includes a retaining device operatively connectable to the slidable sash and to the window frame, for retaining the slidable sash when the sashes are in the folded open configuration.

The hinge assembly can hingedly connect the bottom rail of the upper sash and the top rail of the lower sash, these rails being also referred to as hingedly connected rails. The hinge assembly can include a tube extending along the length of one of the hingedly connected rails; and a socket sized to receive the tube, the socket extending along the other one of the hingedly connected rails. The sashes pivot about the tube when moved between the extended closed configuration to the open folded configuration.

The hinge assembly can reversibly connect the lower sash to the upper sash. The socket contacts the tube only over a portion of the tube, allowing the tube to be disengaged from the socket, when the sashes are in the folded open configuration.

The hinge assembly can include locking pins, for reversibly locking the tube and the socket of the respective hingedly connected rails. The locking pins can be retractable push pins, advantageously allowing the hinge assembly to be disconnected without requiring any tool.

The hinge assembly can include a first profiled section connected to the bottom rail of the upper sash, and a second profiled section connected to the top rail of the lower sash, one of the profiled sections including the socket, and the other profiled section including the tube.

The window assembly can also include at least one balance device located along one of the vertical jambs of the frame, for supporting the weight of the slidable sash.

The slidable sash can be the lower sash. In this case, the window assembly comprises a pivoting assembly for pivotally connecting the frame top section of the upper sash to the vertical frame jambs of the window frame, proximate the frame header. The window assembly can also include a pivoting-and-sliding assembly for pivotally and slidably connecting the frame lower section of the lower sash to the vertical frame jambs of the window frame.

The pivoting assembly can include two pivot pins, operatively connected to left and right sides of the frame top section of the upper sash, respectively, and two receiving devices, for receiving a corresponding one of the pivot pins. Each receiving device can include an enclosure affixable to a corresponding one of the vertical jambs, proximate the frame header, the enclosure including a channel. Each receiving device can also include a receiving block adapted to slide within the enclosure, the block being provided with an aperture aligned with the channel of the enclosure, for receiving a corresponding one of the pivot pins, such that when the sashes are moved from the extended closed configuration to the folded open configuration, the receiving blocks slide slightly downwardly within their respective enclosure, allowing the upper sash to pivot without interference with the frame header.

Each of the enclosures can be removably affixed to the corresponding vertical jamb using a disengaging latch device cooperating with the enclosure and the corresponding vertical jamb. The latch device disengages the enclosure from the frame when operated, thereby allowing the frame upper section of the upper sash to slide downwardly within the window frame, when the sashes are in the folded open configuration.

The pivoting-and-sliding assembly can include two pivot pins, operatively connected to left and right sides of the frame lower section of the lower sash, respectively, and two sliding blocks, each slidably mounted to a corresponding one of the vertical jambs. Each sliding block can be provided with an aperture for receiving a corresponding one of the pivot pins. When the sashes are moved from the extended closed configuration to the folded open configuration, the pivot pins pivot within the respective sliding blocks, and the sliding blocks move upwardly within the respective vertical jambs, away from the frame sill, allowing the frame bottom section of the lower sash to pivot and slide within the window frame.

The pivoting-and-sliding assembly can include a balance device. The balance device includes a retractable spring tape having one end connected to one of the sliding blocks, and the other end connected to a balance retaining block. The balance retaining block can be affixed within a corresponding one of the vertical jambs of the window frame, above the sliding blocks. The balance device thereby supports the weight of the lower sash when moved upwardly.

The retaining device can correspond to the balance device.

The window assembly can include a locking mechanism for locking the sashes in the extended closed configuration. The locking mechanism includes a retractable locking bar inserted within one of the hingedly connected rails; two lock-receiving elements, each affixed to a corresponding one of the vertical jambs of the window frame; and a cam cooperating with the locking bar, for retracting the locking bar from the lock-receiving elements when in an unlocking position, and for extending the locking bar in the lock-receiving elements when in a locking position.

The window frame has an inner side for facing inwardly of a building and an outer side for facing outwardly of the building, one of the hingedly connected rails being provided with a grabbing tab on the inner side of the assembly, for facilitating closing and opening of the sashes from the open configuration to the closed configuration or vice-versa.

One of the hingedly connected rails can be provided with a hiding tab on an outer side of the window frame, for hiding the hinge assembly.

Both sashes can be slidable sashes. The window assembly can include two pivoting-and-sliding assemblies for pivotally and slidably connecting the frame bottom section of the lower sash to the vertical frame jambs of the window frame, and the frame upper section of the upper sash to the vertical frame jambs of the window frame, respectively.

In certain embodiments, a window assembly includes an upright window frame defining a frame opening. The window frame includes a frame header, a frame sill, and a pair of vertical frame jambs extending from the frame header to the frame sill.

The window assembly can also include an upper sash and a lower sash mounted in the window frame, each of said sashes having a top rail, a bottom rail and two vertical stiles extending from the top rail to the bottom rail, for retaining a panel. The upper sash has a top section and a bottom section, the top section being pivotally mounted to the window frame, near the frame header, allowing the upper sash to pivot about its top rail. The lower sash has a top section and a bottom section, the bottom section being pivotally mounted to the window frame, near the frame sill, allowing the bottom sash to pivot about its bottom rail. The lower sash is also slidably mounted to the frame jambs of the window frame, allowing the bottom section of the lower sash to slide vertically within the window frame.

The window assembly can also include a hinge assembly for hingedly connecting the bottom rail of the upper sash with the top rail of the lower sash. The upper and lower sashes are movable between an extended closed configuration and an open folded configuration, wherein in the extended closed configuration, the upper and lower sashes extend within the window frame, closing the frame opening, and in the folded open configuration, the lower sash is raised and brought toward the upper sash, the hinge assembly pointing outwardly from the window frame.

The window assembly can also include a retaining device operatively connectable to the lower sash and to the window frame, for retaining the lower sash in a raised position when the sashes are in the folded open configuration.

In accordance with certain embodiments, a window assembly includes an upright window frame defining a frame opening, the window frame having a frame header, a frame sill, and a pair of vertical frame jambs extending from the frame header to the frame sill.

The window assembly can also include an upper sash and a lower sash mounted in the window frame, each of the sashes including a top rail, a bottom rail and two vertical stiles extending from the top to the bottom rail, for retaining a panel. The upper sash has a top section and a bottom section, the top section being pivotally mounted to the window frame, near the frame header, allowing the upper sash to pivot about its top rail. The lower sash has a top section and a bottom section, the bottom section being pivotally mounted to the window frame, near the frame sill, allowing the bottom sash to pivot about its bottom rail. The lower sash being also slidably mounted to the frame jambs of the window frame, allowing the bottom section of the lower sash to slide vertically within the window frame.

The window assembly can also comprise a hinge assembly for hingedly connecting the bottom rail of the upper sash with the top rail of the lower sash, these rails being also referred to as hingedly connected rails. The hinge assembly can include a tube extending along the length of one of said hingedly rails; and a socket profile sized to receive the tube, the socket profile extending along the other one of the hingedly connected rails.

The upper and lower sashes are movable between an extended closed configuration and a folded open configuration, wherein in the extended closed configuration, the upper and lower sashes extend within the window frame, closing the frame opening, and in the folded open configuration, the lower sash is raised, the lower and upper sashes being pivoted about the tube, the hinge assembly pointing outwardly from the window frame.

The window assembly can also include a retaining device operatively connectable to the lower sash and to the window frame, for retaining the lower sash in a raised position when the sashes are in the folded open configuration.

By window frame, it is meant the outer window frame, within which the frames of the upper and lower sashes, respectively, are mounted.

By sash, it is meant a window panel.

By hinge assembly, it is meant an assembly which can hingedly or pivotally connect the sashes with one another.

As can be appreciated, the upright window assembly advantageously combines a lean and uncluttered aesthetic, excellent air and water tightness properties, a low cost and, within preferential aspect, an ease of access to the exterior side of both sashes. This window assembly presents the same look as a double-hung window when closed, however, it offers increased access when opened, because when in the folded open configuration, air can enter the frame opening either below or above the slidable sash, but also on the sides of the folded sashes.

Another advantage of certain embodiments, is the easiness which with one can open the window regardless of the size or of the number of glass panels used within each of the sashes. As can be appreciated, when the window is opened, the center of gravity of the open sashes is transferred outwardly from the window frame, making it easier and easier to open the window as it is lifted. Simple and inexpensive counterweight devices can thus be used within this type of window, without requiring using any cranks or complex lateral hinges to support the weight of the slidable sash.

BRIEF DESCRIPTION OF THE DRAWINGS

Other objects, advantages and features of the illustrated embodiments will become more apparent upon reading the following non-restrictive description thereof, given for the purpose of exemplification only, with reference to the accompanying drawings in which.

DESCRIPTION OF PREFERRED EMBODIMENTS

Figure 1:
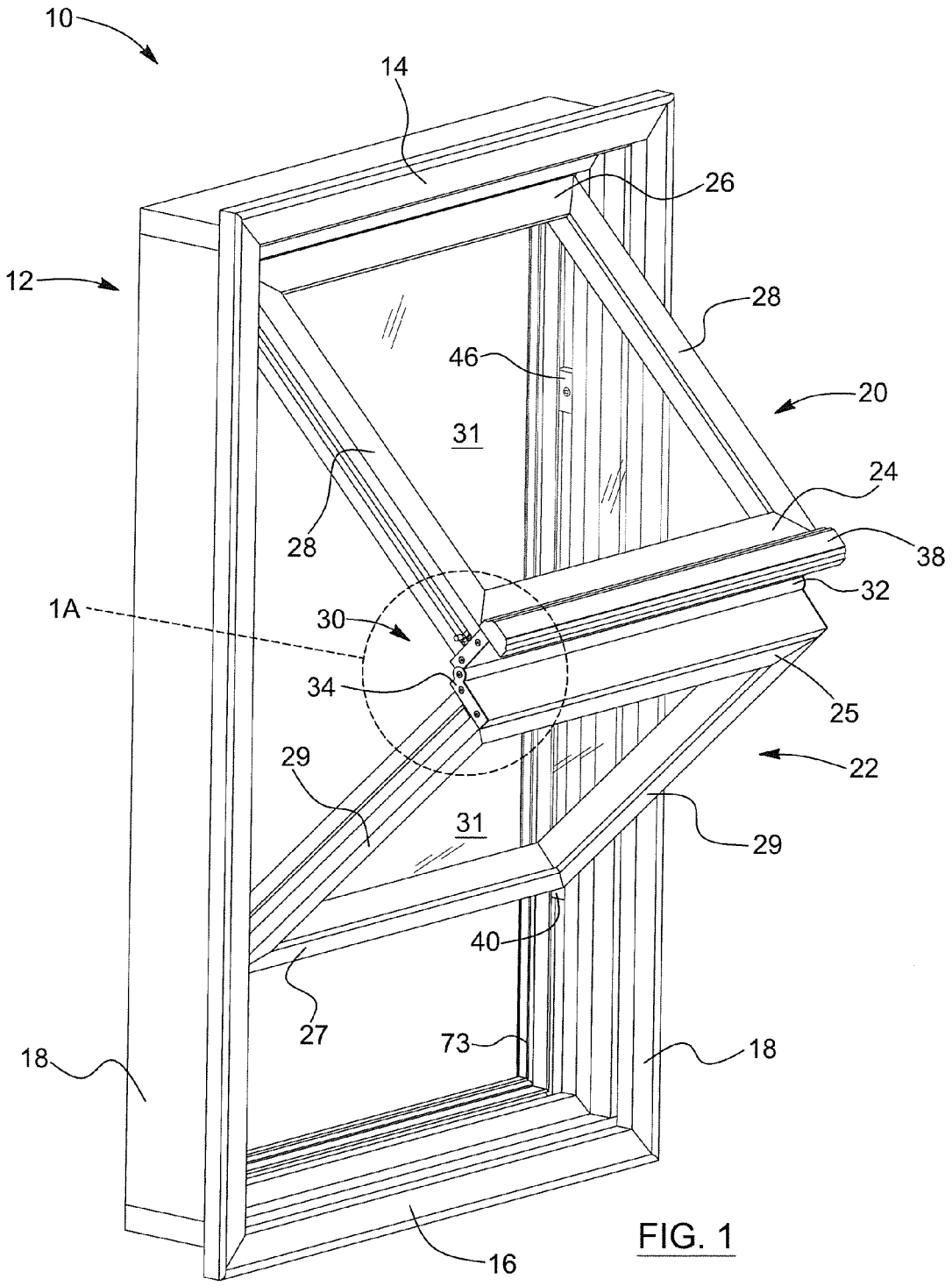
FIG. 1 is a perspective view of a window assembly, viewed from the outside, according to a first embodiment.

In the following description, similar features in the drawings have been given similar reference numerals. In order to preserve clarity, certain elements may not be identified in some figures if they are already identified in a previous figure.

Referring to FIG. 1, a window assembly 10 according to a first embodiment is shown. The window assembly 10 includes an outer frame 12, an upper sash 20 and a lower sash 22. The outer frame 12 is formed by a frame header 14, a frame sill 16, and two vertical jambs 18. The frame of the upper sash 20 includes a top rail 26, a bottom rail 24, and two vertical stiles 28, for retaining a glazing or panel 31. The frame of the lower sash 22 also includes a top rail 25, a bottom rail 27 and two vertical stiles 29, for retaining a glazing 31. The framing members 24, 25 are hingedly attachable to one another, such as by a hinge assembly 30, that they may be removably or permanently attached. The framing members 24, 25 are pivotally connected to the outer frame 12, allowing the sashes 20, 22 to pivot or rotate with respect to their respective framing member 26, 27, about a horizontal axis. While in this embodiment it is the top rail 26 and bottom 27 that are pivotally connected to the frame 12, it can be considered to pivotally affix the upper portion of the vertical stiles 28, and the lower portion of the vertical stiles 29 to the frame 12. In order to allow the sashes 20, 22 to be folded up towards one another, at least one of the rails 26 and 27 is slideably connected to the outer frame 12, for allowing the corresponding sash, in this case the lower sash 22, to slide into the outer frame. The hinge assembly 30 can be located on the interior side, i.e. the side facing the interior of the building, of the hingedly connected rails 26, 27, such that the sashes 20, 22 extend outside the building when in they are folded up. The upper and lower sashes 20, 22 are thus movable one with respect to the other between an extended closed configuration, and a folded open configuration, as in FIG. 1. The outer frame 12 and the sashes 20, 22 can be made of any material, such as wood, composite material, PVC or aluminum. Advantageously, when the window assembly 10 is opened and it rains, water is less likely to enter the building, since the upper sash forms a canopy.

Figure 4:
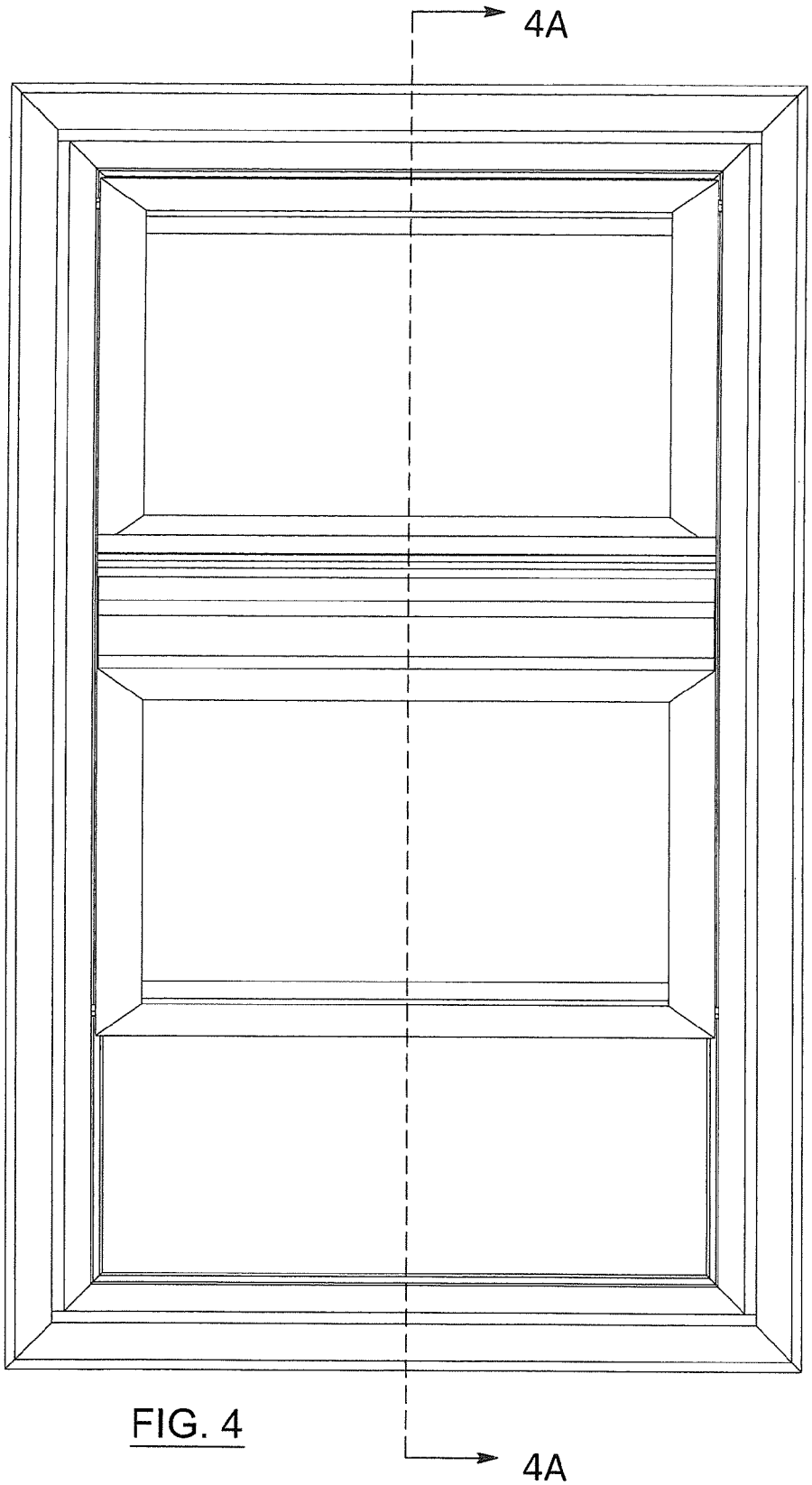
FIG. 4 is a front view of the window assembly of FIG. 1, in the folded open configuration.
Figure 4A:
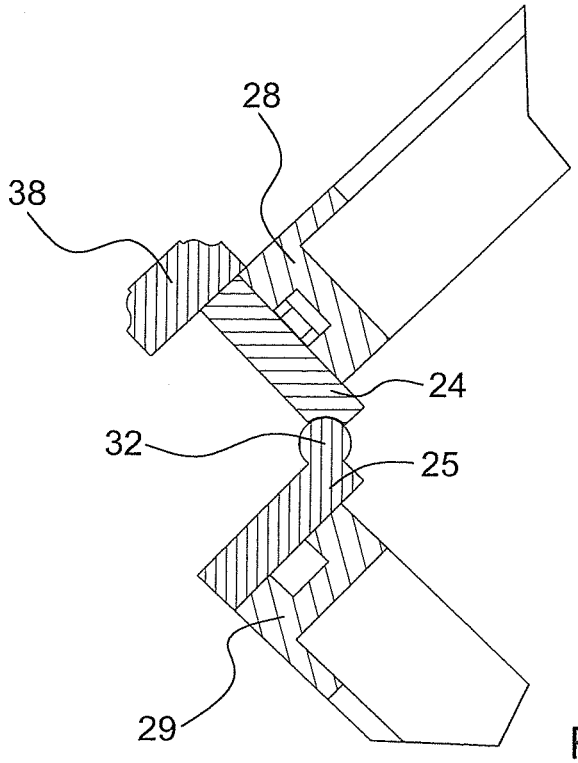
FIG. 4A is a partial cross-section view of the window assembly of FIG. 4, taken along line 4A-4A.
Figure 4B:
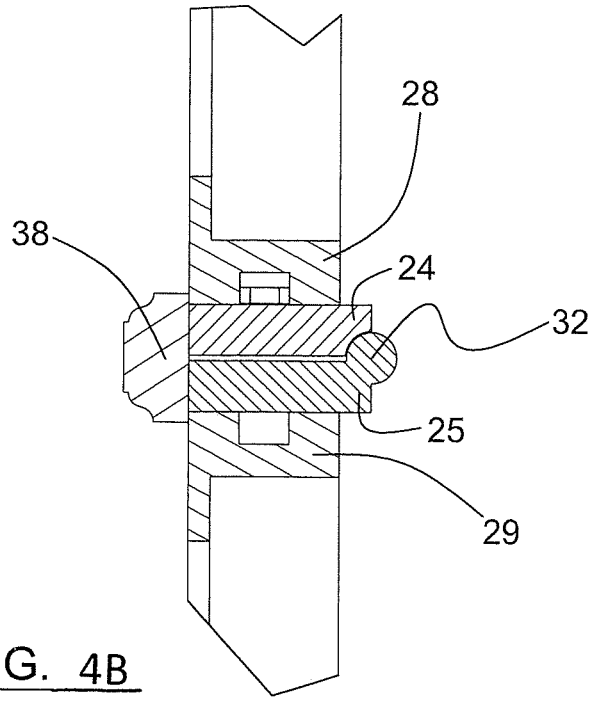
FIG. 4B is a partial cross-section view of the window assembly of FIG. 4, in an extended closed configuration.
Figures 5, 5A, 5B:
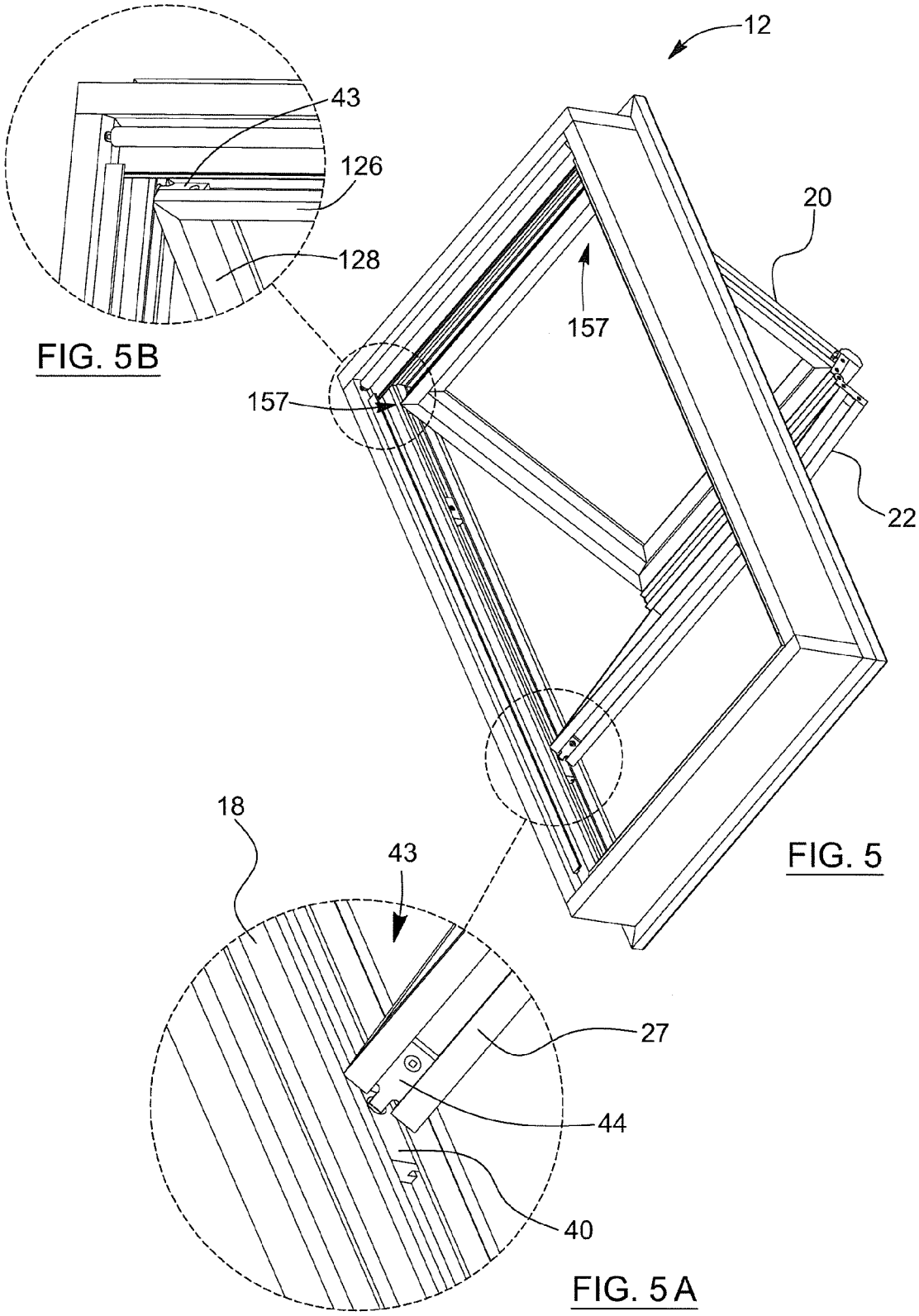
FIG. 5 is a bottom perspective view of the window assembly of FIG. 1.
FIG. 5A is a close-up view of a portion of the window assembly of FIG. 5, showing the connection of the lower sash within the window frame.
FIG. 5B is a close-up view of a portion of the window assembly of FIG. 5, showing the connection of the supper sash within the window frame.

Still referring to FIG. 1, and also to FIGS. 4B and 4C, the hinge assembly 30 is a tube-and-socket joint embodied by the top rail 25 of the lower sash 22 having an inside edge with a tube-shaped profile 32 extending along the length of the rail 25; and the bottom rail 24 of the first sash 20 having an inside edge with a socket-shaped profile sized to receive the tube-shaped profile of top rail 25 of the lower sash 22. Because of the use of such a tube-and-socket joint, the look of the joint between the sashes viewed from the interior of the building when the window is closed is clean and uncluttered. The hingedly connected rails 24, 25 are secured via a pair of hinges 34, affixed at both ends of the vertical stiles 28, 29. It should be noted that in this particular embodiment of window assembly 10, the hinges 34 could be omitted and the window could still be opened and closed properly. The weight of the upper sash 20 against the lower 22, and the socket-shaped profile of the top rail 24 are sufficient to maintain the tube-shaped profile in place and allow rotation of the sashes 20, 22 at this connecting point. In this configuration, the window sashes 20, 22 can be removably attached. However, in order to increase the robustness of the window assembly 10, hinges 34 are preferably used, and the sashes 20, 22 are permanently hingedly attached. In another mode of realization not illustrated, the interior edge of both hingedly connected rails 24, 25 has a socket-shaped profile, the hinge assembly including a rod extending in the socket-shaped profile. In this case, the rod 32 could be made of PVC, and the hinges 34 of steel or any other metal.

Advantageously, with this type of hinge assembly 30, a decorative molding 38, or hiding tab, can be placed on either one of the rails 24, 25 to hide the hinge assembly 30, providing a clean and sophisticated look from the outside when the window is closed.

Figure 2:
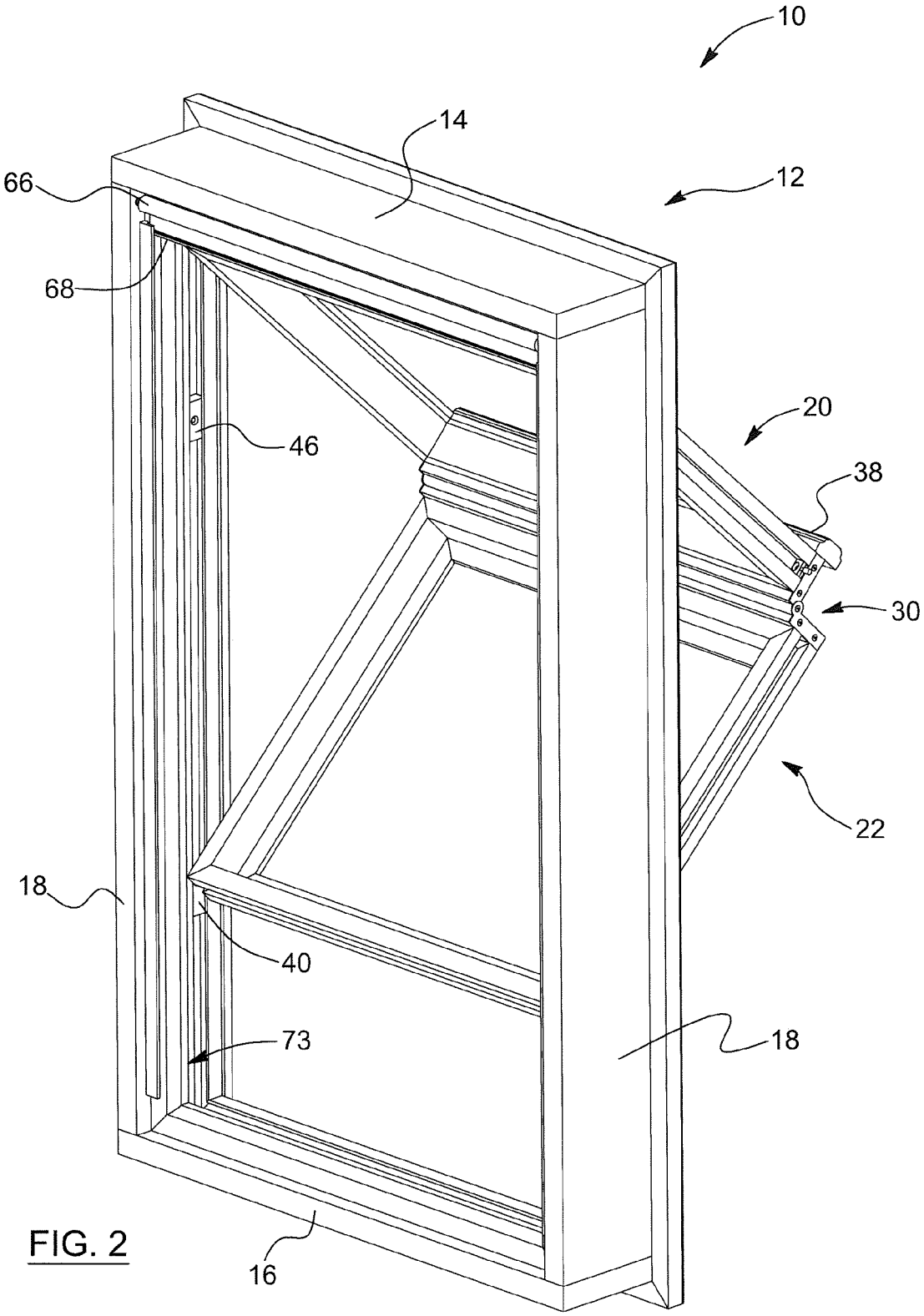
FIG. 2 is a perspective view of the window assembly of FIG. 1, viewed from the inside.

Referring to FIGS. 1 and 2, the window assembly 10 is provided with weather strips 73, located on the entire periphery of the outer frame 12, and towards the interior of the building with respect to the sashes 20, 21 such that the weather strips 73 are compressed by the edges of the sashes 20, 21 when the window is in the closed configuration. Of course, the weather strips 73 can also be located on the inner surface of the sashes 20, 22, as they would also be compressed against the outer frame 12 when the window 10 is closed. Since both sashes, when in the closed configuration, are compressing the weather-strips 73, the window 10 has excellent air tightness and water tightness properties.

Best shown in FIG. 2, the window assembly 10 can be provided with a mosquito screen 66, such as a spring rolled screen, or a screen operated with a chain, located near the frame header 14 of the outer frame 12. The mosquito screen is provided on the inner side of the window assembly, towards the interior of the building. The screen can be unrolled or unwounded downwardly to be in an operating configuration. The screen 66 can be provided with a weight 68 at its bottom side, in order to tense the screen when unrolling and locking it in the frame sill 16. Channels are provided in the vertical jambs 18 to guide the lateral sides of the screen 66 when being unrolled. Advantageously, when the sashes 20, 22 are in the extended closed configuration, the mosquito screen 66 can be completely rolled up, increasing the aesthetic look of the window and allowing natural light to enter the building without being blocked. When the window is closed, people can also look through it without having their view crossing the mosquito screen. When the cold season begins, the mosquito screen 66 does not need to be removed, and can left in placed, rolled up, along the frame header 114, which is a great advantage over single and double-hung windows, in which mosquito screens are left in place during the warm seasons, even when the windows are closed, and are removed when winter comes.

Now referring to FIGS. 3B-3C, 5, 5A and 7, the lower portion of lower sash 22 slides and pivots within the frame 12, by employing a pivoting-and-sliding assembly 53. The pivoting-and-sliding assembly 53 includes a pair of sliding blocks 40, each being inserted in a C-profile 41 (best shown in FIG. 3C) of the vertical jambs 18 of the outer frame 12. Best shown in FIGS. 3C and 7, the sliding block 40 has three sliding surfaces 42, in order allow it to glide smoothly against the walls of the C-profile 41. Contrary to conventional sliding blocks, the block 40 do not require any blocking mechanism and can always be in a sliding configuration, which simplifies its design. A pivot device 43 is attached at each lower corner of the lower sash 22. Although the pivot device 43 is shown with two orthogonal faces connectable to the lower corner of the sash 22, it can also be provided with only one connecting face. The pivot device 43 further comprises a pivot bar, or pin, 44 insertable in an aperture 45 of the corresponding block 40, and allows the sash 22 to rotate with respect to the vertical jambs 18.

Figure 6:
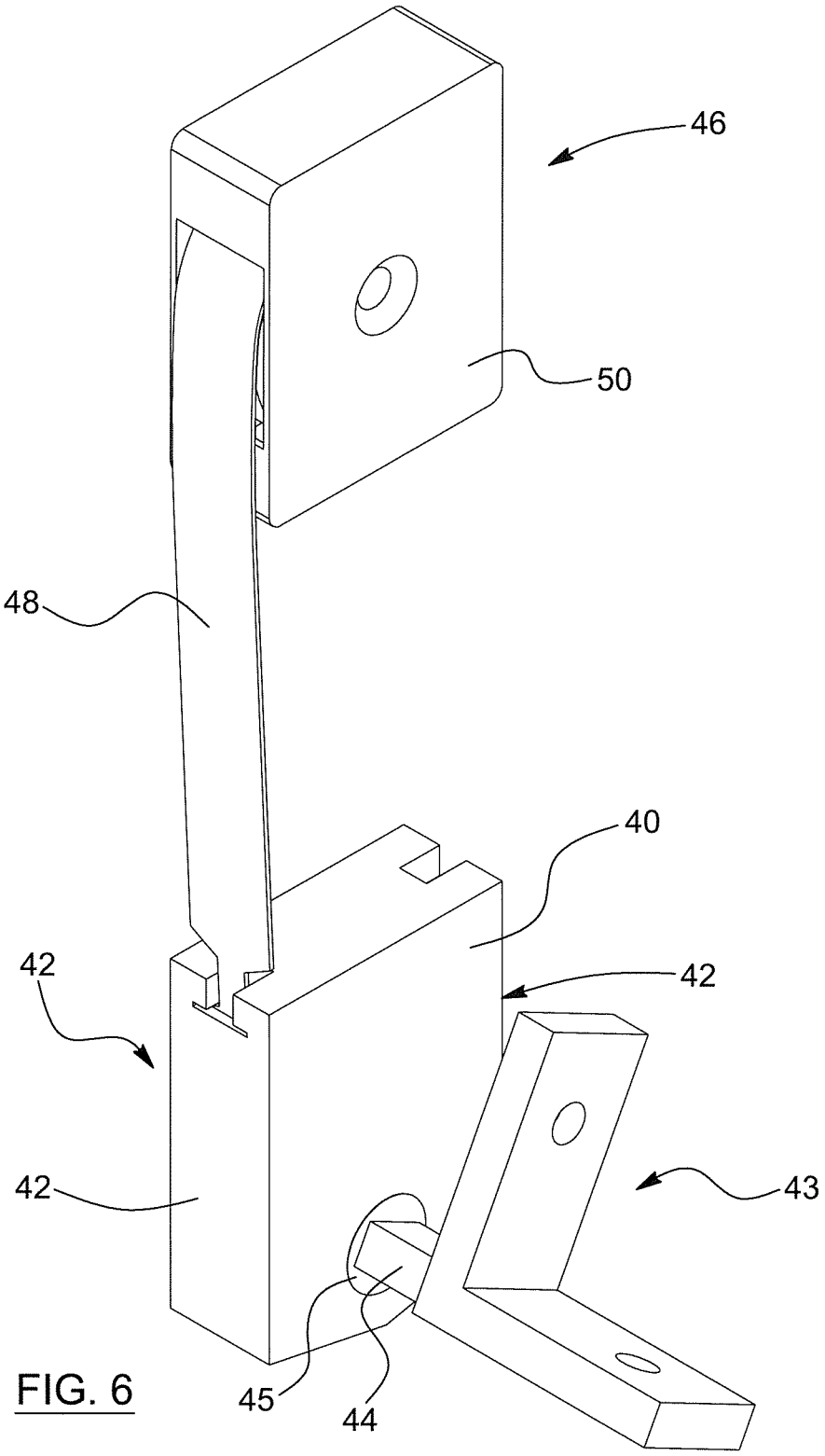
FIG. 6 is a perspective view of an embodiment of a pivoting-and-sliding assembly for use in the window assembly of FIG. 1.
Figure 7:
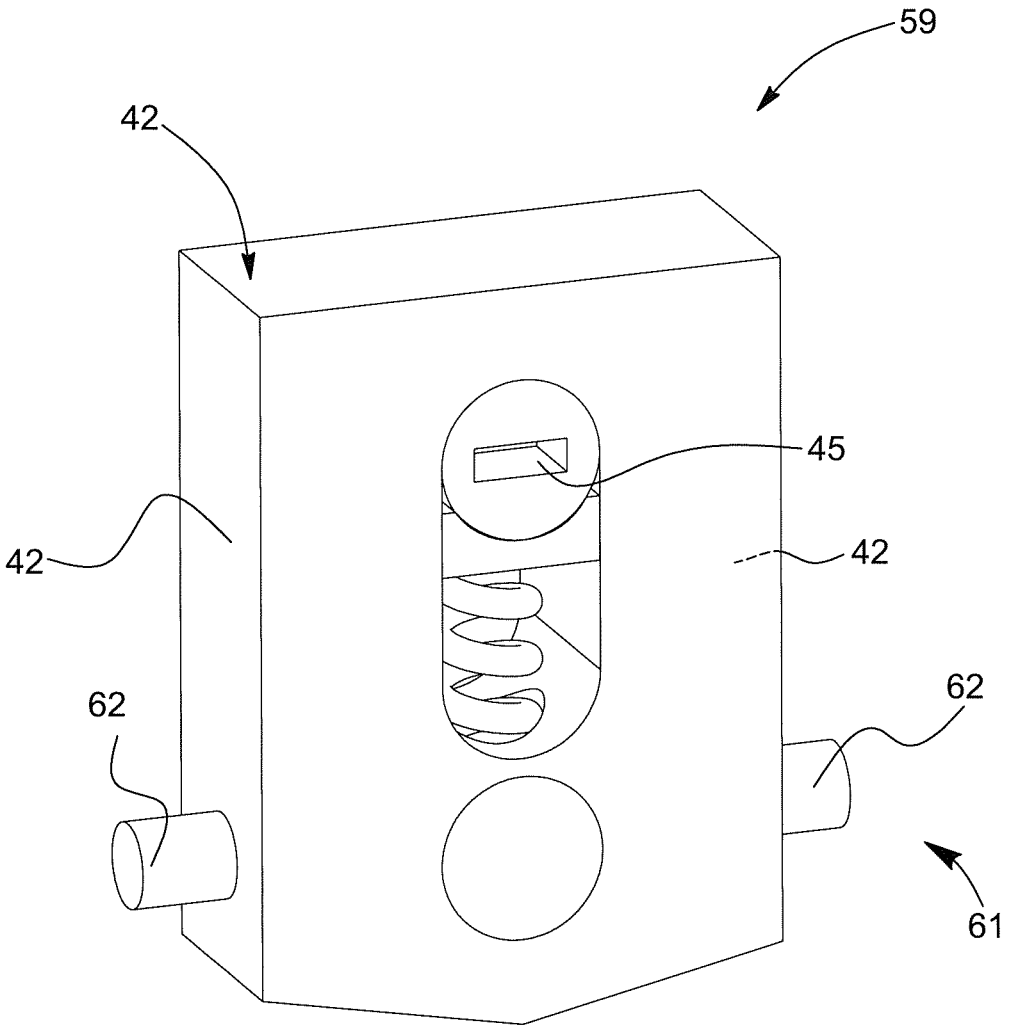
FIG. 7 is a perspective view of an embodiment of a disengaging latch device for use in the window assembly of FIG. 1.

Referring to FIGS. 1, 2 and 6, the window assembly 10 can be provided with a balance mechanism 46, to facilitate the lifting of the lower sash 22. The balance mechanism includes a spring tape 48 rolled up in a balance retaining block, or casing 50. The spring tape 48 has one end attached to the sliding block 40, and the casing 50 is affixed within the outer frame, at approximately two third of the height of the window. Of course, other equivalent mechanisms can be used.

Now referring to FIGS. 3, 3A, 5, 5B and 7, the upper sash 20 is also provided with a pivoting assembly 53. The pivoting assembly includes two pivot devices 43, at each top corner of the upper sash 20, each device 43 including a pivot bar, or pin, 44, similar to the one used for the lower sash 22. The pivot bars 44 on the left and right corners of the upper sash cooperate with receiving blocks 59, shown in FIG. 7. The pivot devices 43 are connected to the corners of the top section of the upper sash 20, and the receiving blocks 59 are mounted in the vertical stiles 28, near their top end. The receiving blocks 59 can be further provided with a disengaging latch device 61, to prevent or allow the receiving blocks 59 to slide within the vertical jambs 18. More specifically, in the mode of realization illustrated, the disengaging latch device includes blocking pins 62 which extends out of the block 59 and channels 64, best shown in FIG. 3A, located in the upper portion of the vertical jamb 18 to receive the blocking pins. When the blocking pins 62 extend into the channel 64, the upper sash 20 is prevented from sliding downwardly toward the lower sash when being folded. The upper sash 20 can nevertheless slide very slightly, such as a few millimeters, in order to have enough clearance to pivot without constraints, or in other words, without interfering with the frame header 14. This slight translation is possible because the channels 64 have an elongated or oblong shape, allowing the pins 62 to translate in the holes. Such configuration allows the sashes 20, 22 to be tightly closed and comply with stringent A, B, C test well known in the industry for noise, air and water tightness. In the mode of realization illustrated, each of the receiving blocks 59 of the upper sash 20 is provided with two of said blocking pin 62, one extending from each side of the block 59. Of course, it can be considered to having only one the blocking pin extending from the back face of the sliding block 59.

By combining the rotation of the sashes 20, 22 about their horizontal rails 26, 27 and their hingedly connected rails 24, 25, and the vertical translation of the bottom rail 27, the window assembly 10 can be slid and folded in an open configuration. While one may think the lifting of two sashes is heavy and difficult, lifting the sashes in this particular configuration is easy and effortless. This is mainly due to the fact that when being raised, the gravity center of the sashes 20, 22 is moved farther away from the outer frame 12, and thus the lifting of the sashes 20, 22 gets easier and easier as they are being raised. The balance device 46 advantageously facilitates the lifting of the lower sash 22 at the initial stage of opening the window.

Figure 3A:
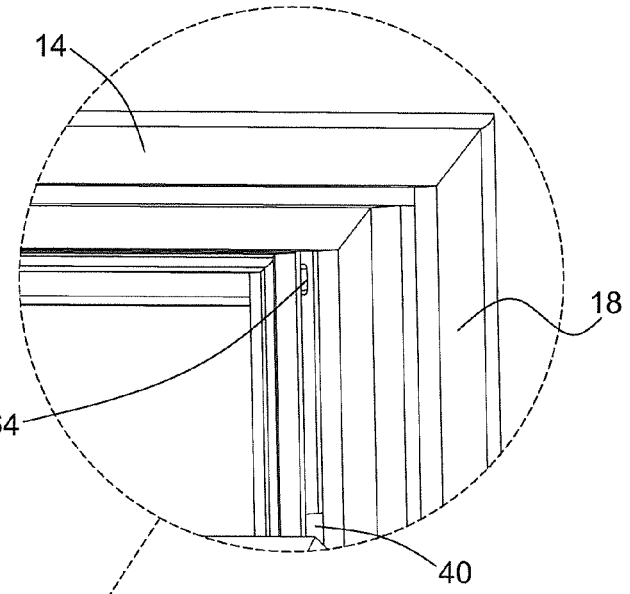
FIG. 3A is a close-up view of an upper portion of the window frame of FIG. 3.
Figure 3:
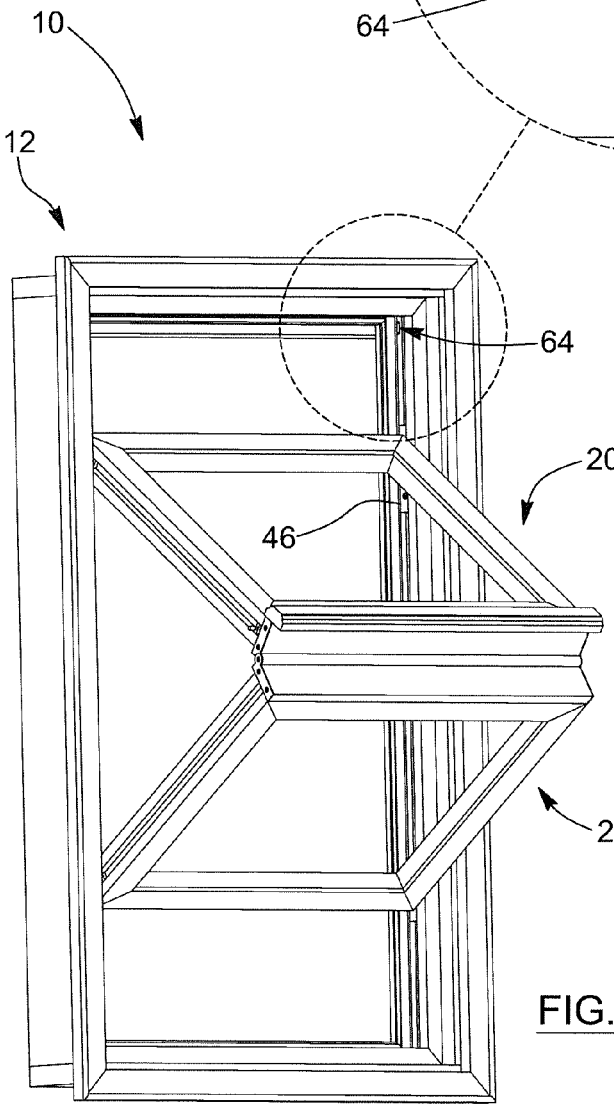
FIG. 3 is a perspective view of the window assembly of FIG. 1, viewed from the outside, with the upper sash being lowered.
Figure 3B:
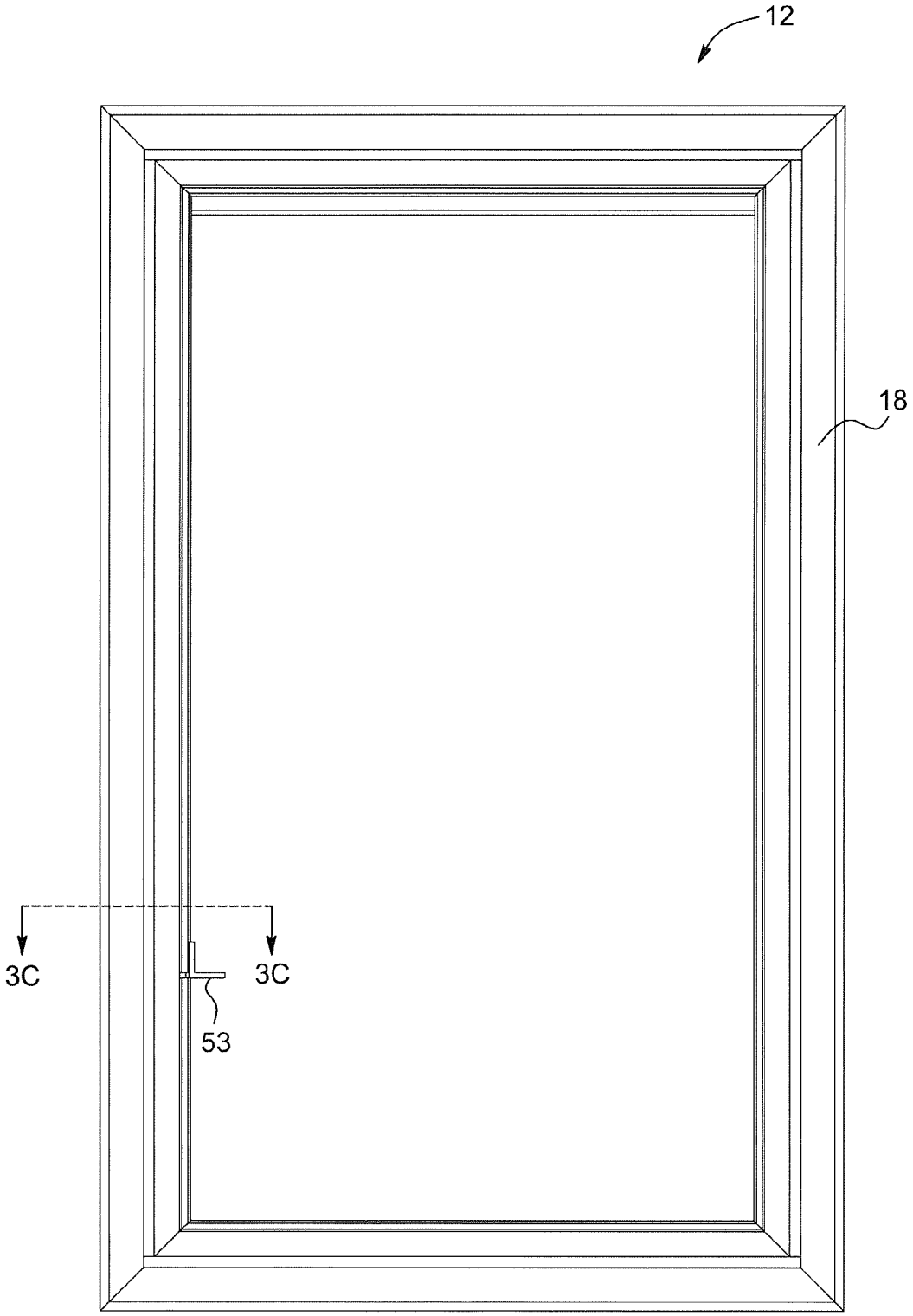
FIG. 3B is a front view of the window frame of FIG. 3, without the sashes, and with some elements of a pivoting-and-sliding assembly inserted within one of the vertical jamb.
Figure 3C:
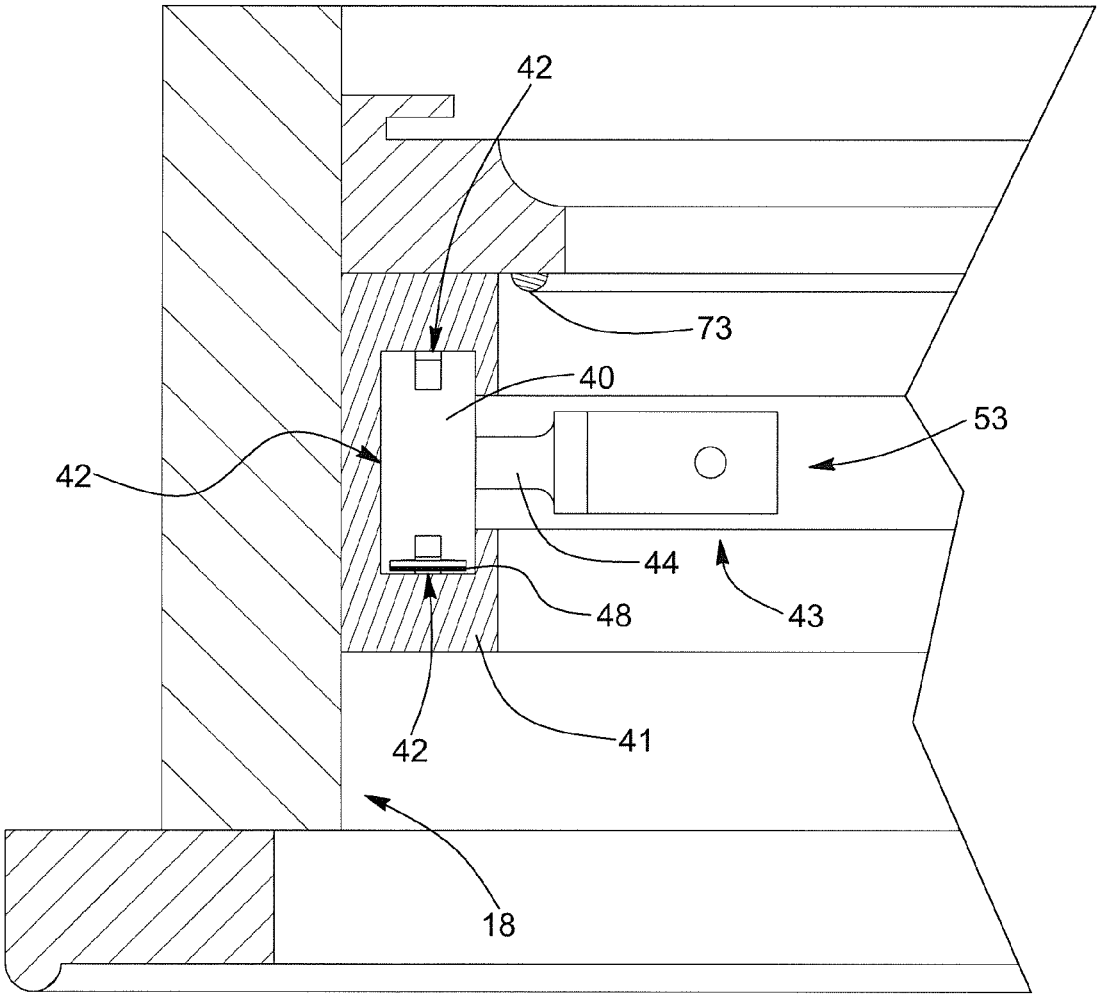
FIG. 3C is a cross-section view taken along the line 3-3 of the window frame of FIG. 3B.

Now referring to FIG. 3, the window assembly 10 is shown in a configuration where the top rail 26 of the upper sash 20, and the bottom rail 27 of the lower sash 22 have been translated inwardly, thus creating an opening above the upper sash 20 and below the lower sash 22. This configuration is particularly useful because it allows the external faces of the glazing of the sashes 20, 22 to be accessed, for example for cleaning purposes. Best shown in FIG. 7, this translation of the upper sash 20 is possible because of the disengaging latch device 61, which in this case includes blocking pins 62 which are retractable pins 62 movable between a forced retracted position, where the pins 62 are retracted within the receiving block 59, and a biasing extended position, where the pins 62 extend out of the block 59. The disengaging latch device 61 further comprises a release button 63 operatively connected to the pins 62 to move the same from the extended position to the retracted position. By retracting the pins 62, the upper sash 20 is free to slide downwardly, until being blocked by the casing 50 of the balance device 46. This particular arrangement provides the advantage of providing access to internal and external surfaces of both sashes, without having to disassemble or remove the sashes 20, 21 from the outer frame 12. By keeping both sashes 20, 21 within the frame 12 during their cleaning, a consumer can wash their windows without having to manipulate or hold the sashes, which is a great improvement over existing double-hung windows.

Figure 1A:
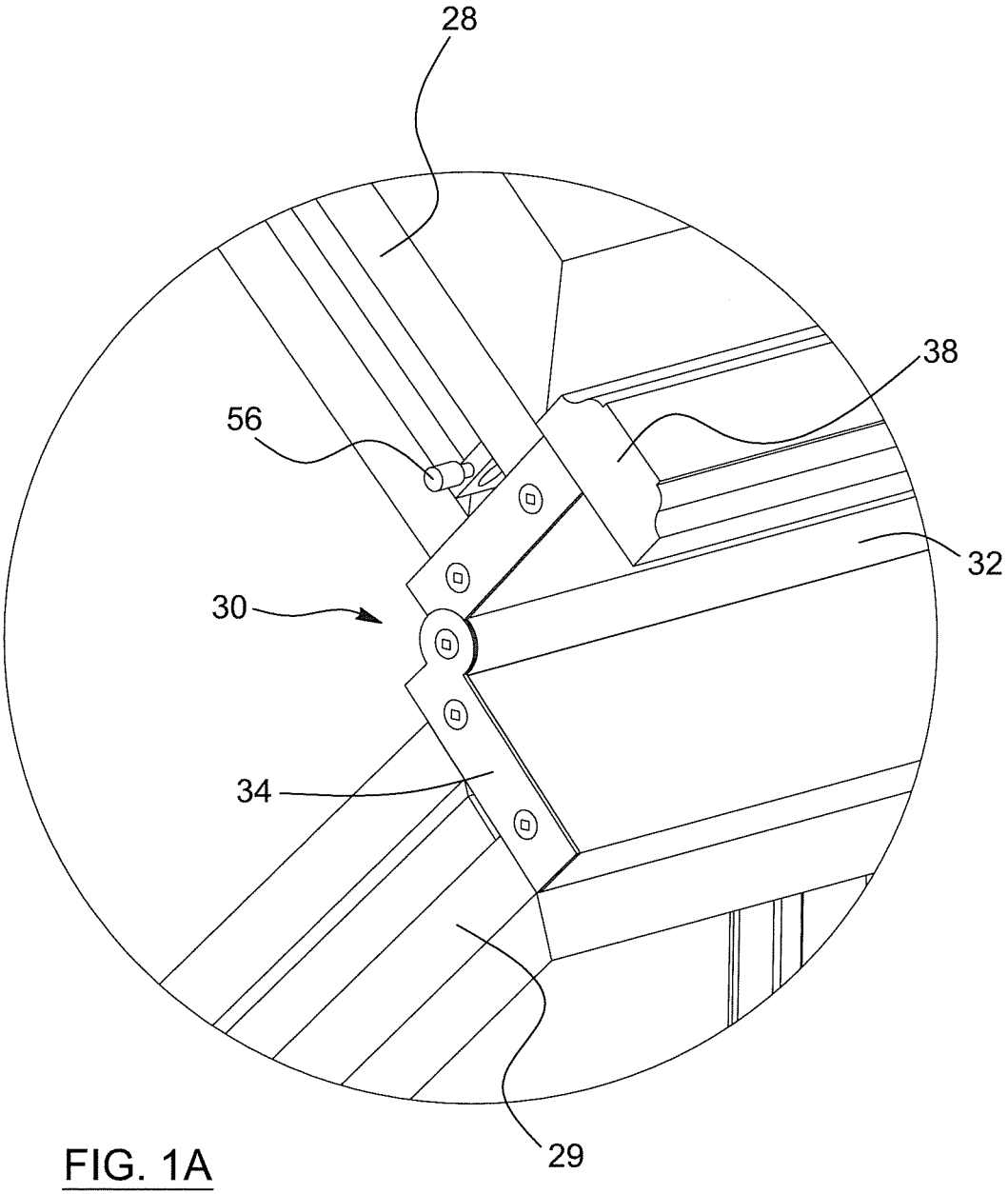
FIG. 1A is a close-up view of the sashes of the window assembly of FIG. 1.
Figure 17:
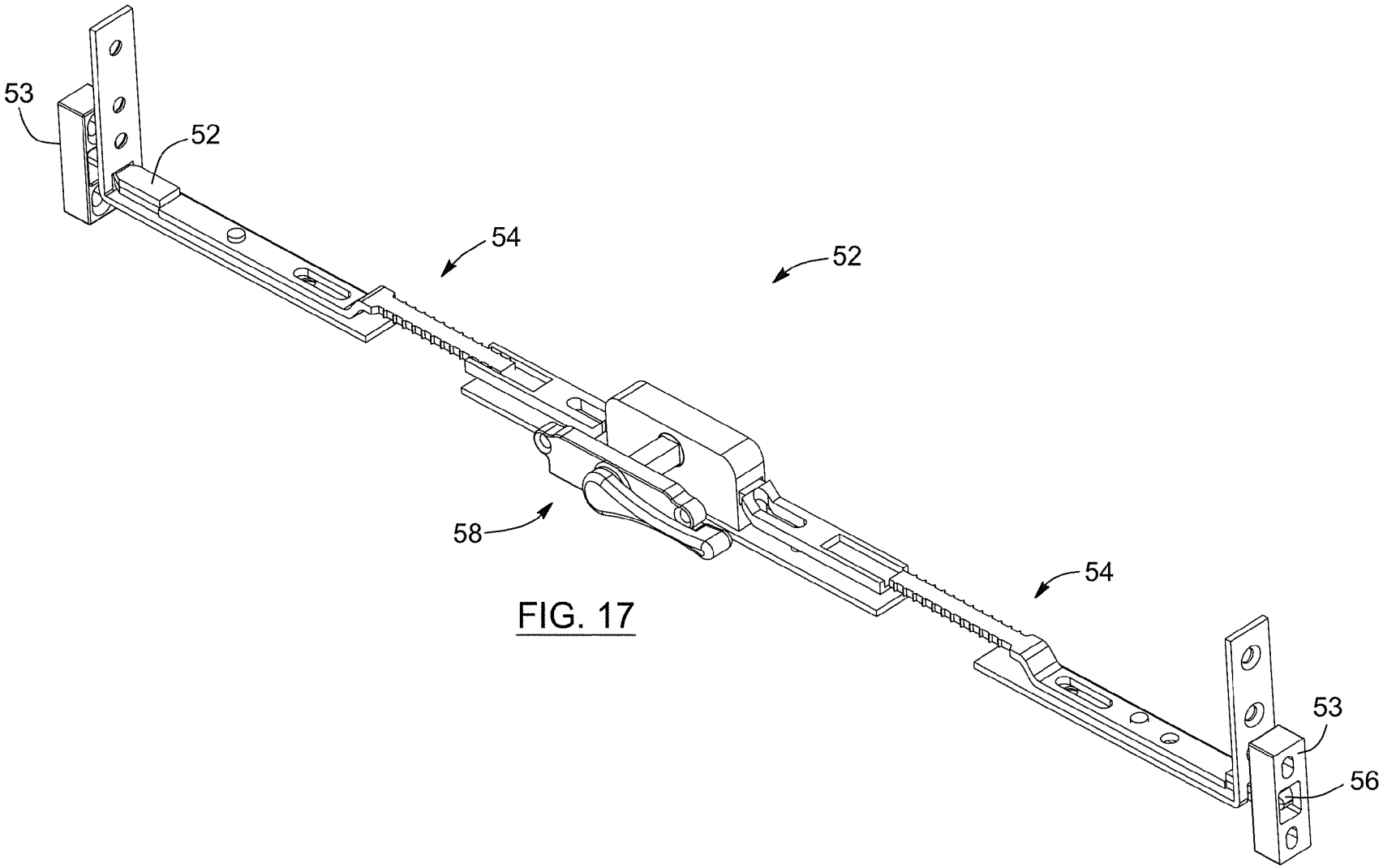
FIG. 17 is a perspective view of a locking mechanism for us with the window assembly of FIG. 8.

Now referring to FIGS. 1A and 17, one of the sashes 20, 22 can be provided with a locking mechanism 52 to lock the sashes in the closed configuration. The locking mechanism includes locking bars 54 (best shown in FIG. 17) inserted within one of the hingedly connected rails 24, 25 and hidden in an inner channel. The locking bar 54 works like a dead bolt lock. More specifically, the locking mechanism comprises two retractable bars 54 extending from each side of an actuating assembly. Both retractable bars 54 are provided at their outer end with a locking pin 56. The actuating assembly comprises a cam 58 to which are attached the retractable bars 54 and a knob connected to the cam 58 for rotating the same and thereby moving the retractable bars 54 between a retracted position and an extended position where the locking pins are devised to extend into lock-receiving elements 53 affixed within the vertical jambs 18, to lock the window. To unlock the mechanism 52, the cam is rotated by using the knob to move the bars 54 in the retracted position inside the rails 24 or 25, allowing the sashes to be opened. Of course, other types of locking mechanism 53 can be considered, such as using two locks, one at each side of the hingedly connected rails 24, 25.

Figure 8:
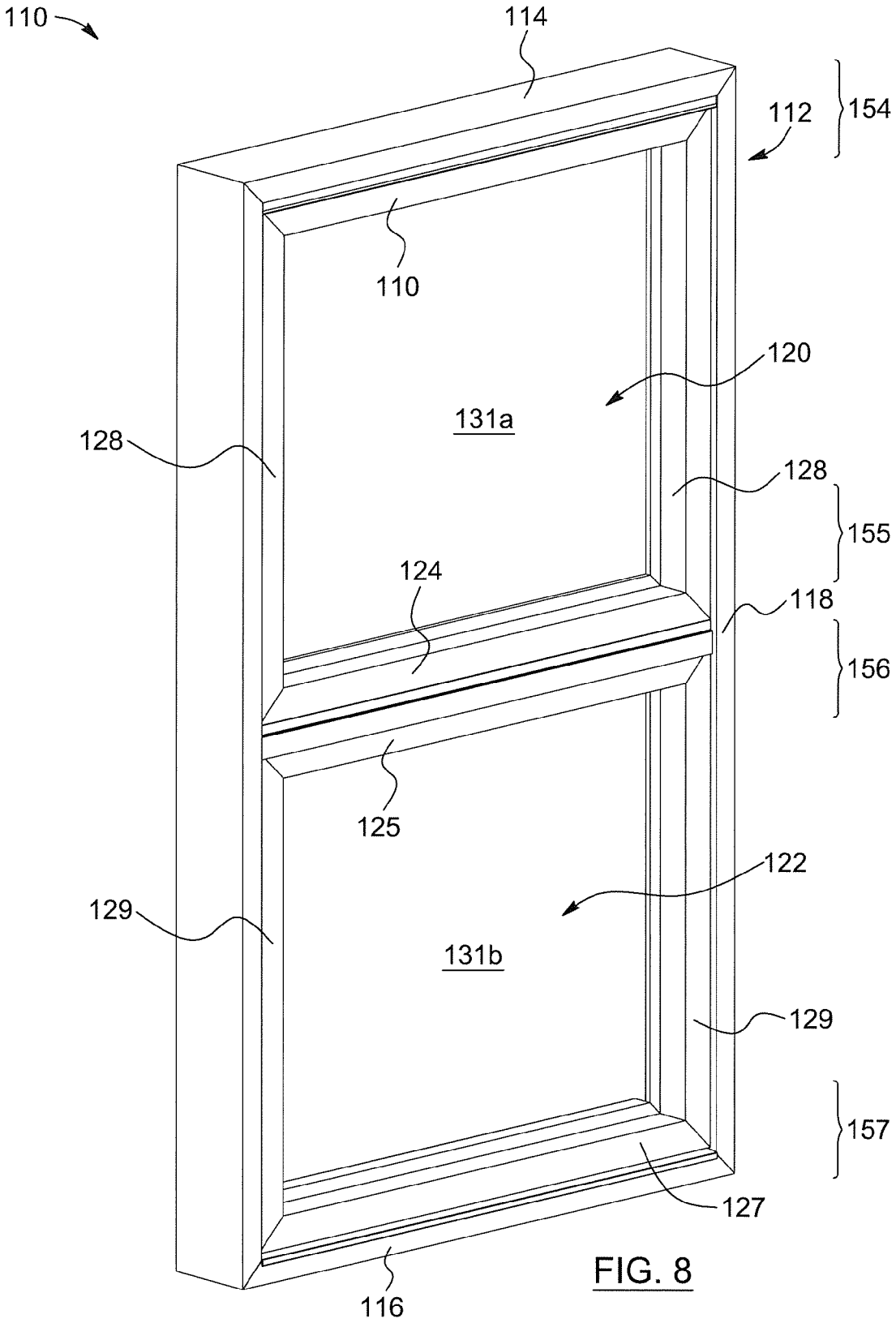
FIG. 8 is a perspective view of a window assembly in the extended closed configuration, viewed from the outside, according to a second embodiment.
Figure 9:
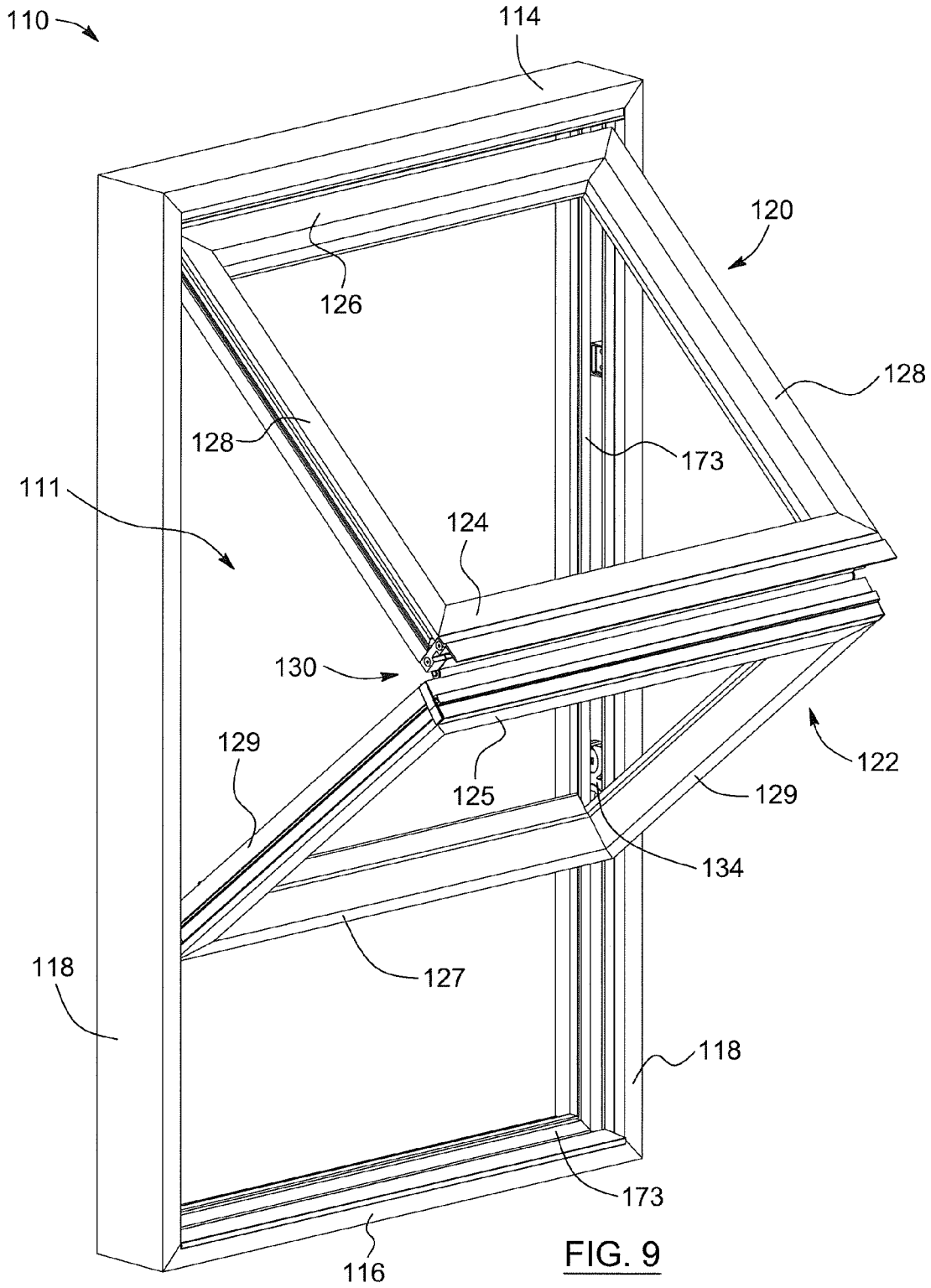
FIG. 9 is a perspective view of the window assembly of FIG. 8, in an open folded configuration, viewed from the outside, according to a second embodiment.
Figure 10:
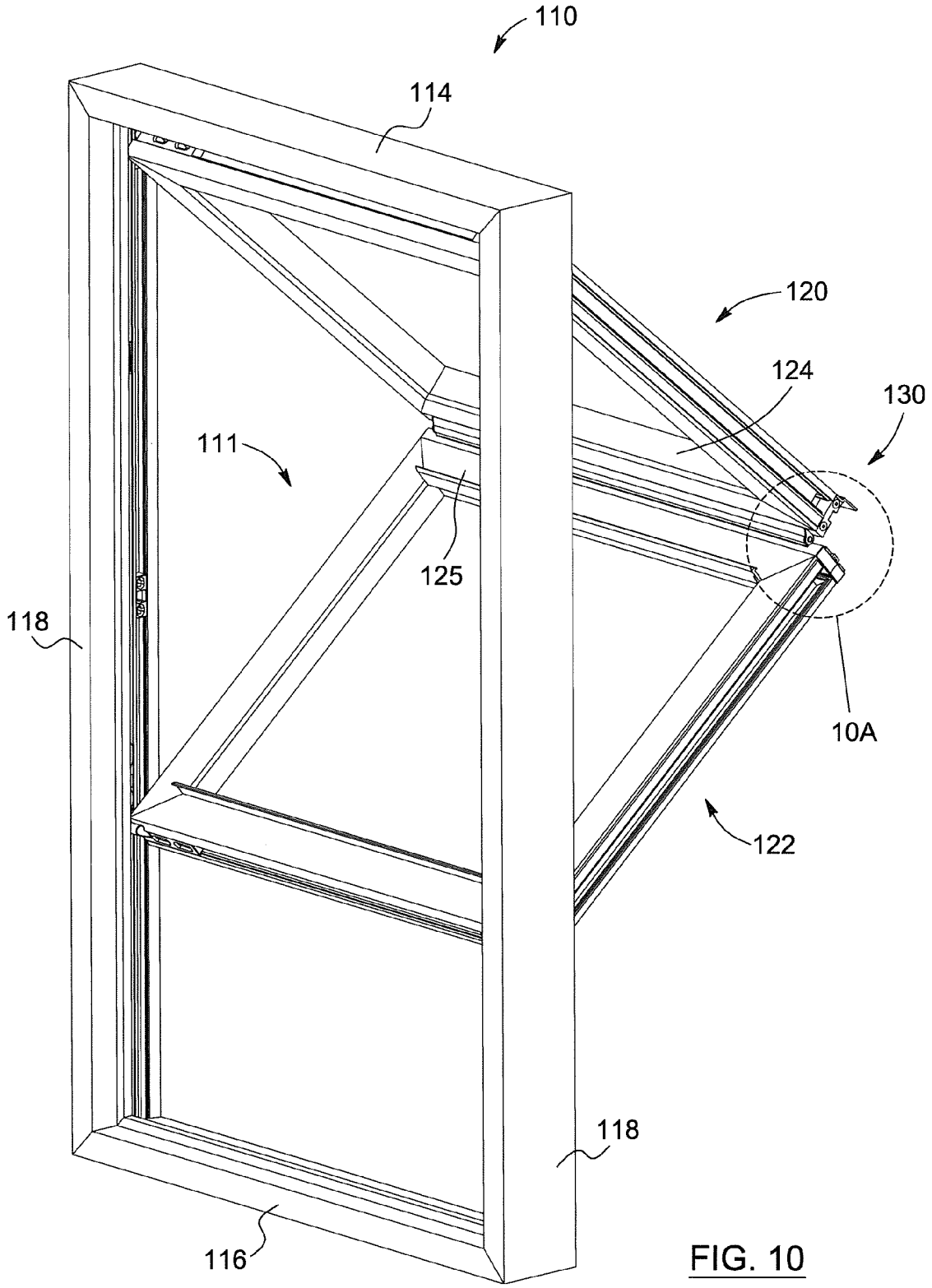
FIG. 10 is a perspective view of the window assembly of FIG. 9, viewed from the inside.

With reference to FIGS. 8 to 10, a second embodiment of a window assembly 110 is shown. The window assembly includes an upright window frame 112 which defines a frame opening 111. The window frame 112 includes a frame header 114, a frame sill 116, and a pair of vertical frame jambs 118 extending from the frame header 114 to the frame sill 116.

An upper sash 120, or upper window panel, and a lower sash 122, or lower window panel, are mounted in the upright window frame 112. Each of the sashes 120,122 includes a sash frame and a panel 131*a* or *b*, also referred to as a glazing. The upper sash frame includes a top rail 126, a bottom rail 124, and two vertical stiles 128 extending from the top rail 126 to the bottom rail 124. Similarly, the frame of the lower sash 122 includes a top rail 125, a bottom 127, and two vertical stiles 129 extending from the top rail 125 to the bottom rail 127. The frames of the upper and lower window sashes 120,122 are for retaining the panels 131*a* and 132*b*, respectively.

The frame of the upper sash 120 has a top section 154 and a bottom section 155. The top section 154 is pivotally mounted within the window frame 112, allowing the upper sash 120 to pivot about its top rail 126. The frame of the upper sash can be connected to the window frame 112 at both of its right and left top corners.

Similarly, the frame of the lower sash 122 has a top section 156 and a bottom section 157, the bottom section 157 being pivotally mounted to the window frame 112, allowing the lower sash 122 to pivot about its bottom rail 127. The frame of the lower sash can be connected to the window frame 112 at both of its right and left bottom corners.

At least one of the upper and lower sashes 120,122 is also a slidable sash. In the case illustrated, the slidable sash is the lower sash 122. In addition to being pivotally mounted to the window frame 112, the slidable sash is also slidably mounted to the frame jambs 118 of the window frame 112. The slidable sash can thus not only pivot relative to the window frame 112, but it can also slide vertically within the frame 112.

A hinge assembly 130 hingedly connects the frame bottom section 155 of the upper sash 120 with the frame top section 156 of the lower sash 122. The hinge assembly 130 enables the upper and lower sashes 120,122 to pivot about a horizontal axis, with respect to one another.

The upper and lower sashes 120,122 can be moved between an extended closed configuration, as shown in FIG. 8, and an folded open configuration, as shown in FIGS. 9 and 10. In the extended closed configuration, the upper and lower sashes 120,122 extend within the window frame 112 closing the frame opening 111. In the folded open configuration, the slidable sash, in this case the lower sash 122, is brought towards the other sash, in this case the upper sash 120, and the hinge assembly 130 points outwardly from the window frame 112. When the sashes 120,122 are in the folded open configuration, a retaining device 134 retains the slidable sash 122 to the window frame 112, thus retaining the slidable sash 122 in the open folded configuration. The retaining device 134 can be of various types. It can be for example a simple block placed within the bottom rail 127 and the frame sill 116 or a rack-and-pinion system allowing to open the window at preset opening heights. The retaining device 134 can be a balance device mounted within the window frame 112. Weather strips 173 can be provided on the framing elements 114, 116, 118 of the outer frame 112, such that they are compressed by the frames of the sashes 120, 122 when the sashes are in the extended closed position.

Figure 10A:
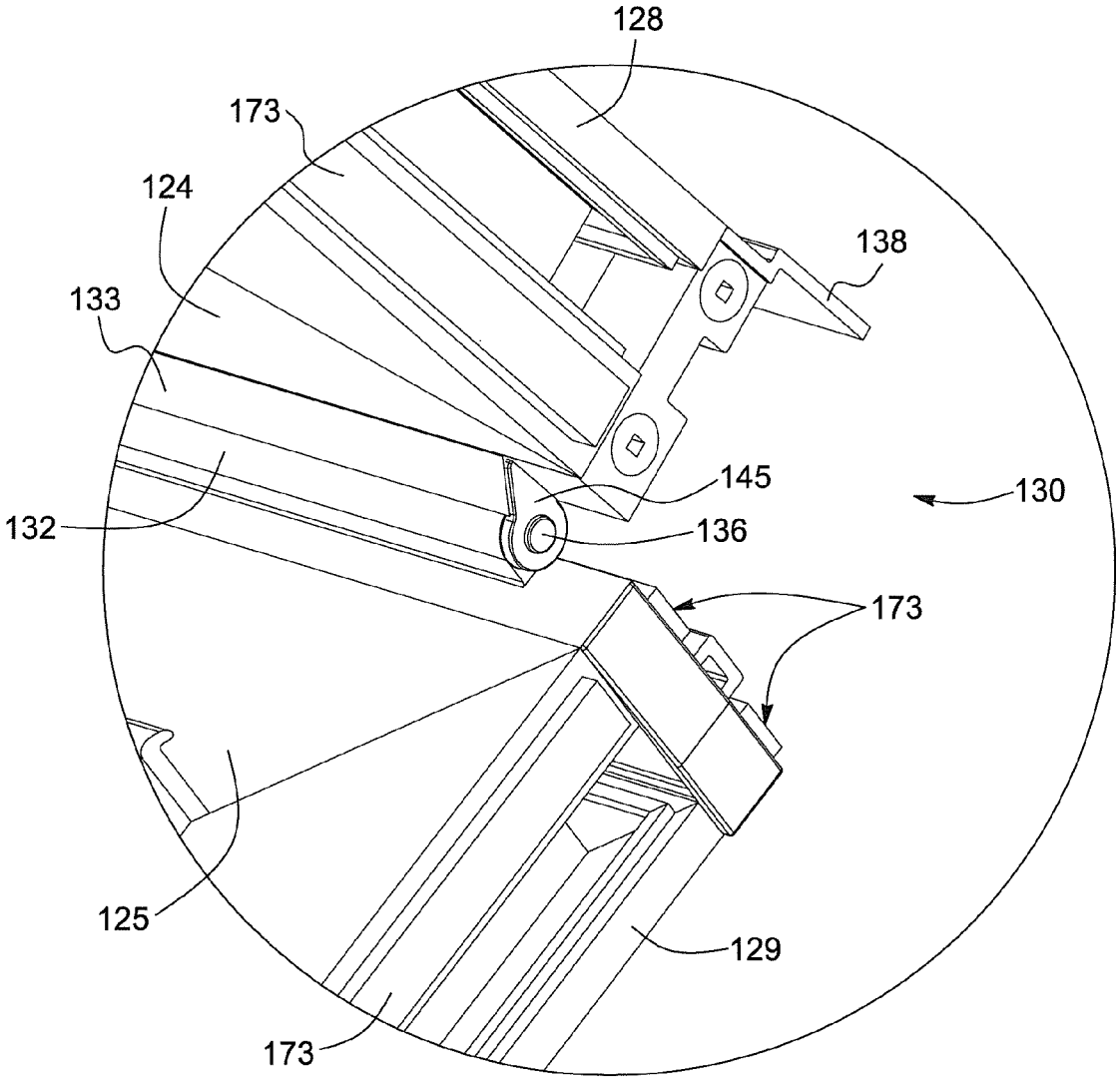
FIG. 10A is a close-up view of section 10A of FIG. 10, in which the upper and lower sashes are shown hingedly connected.
Figure 10B:
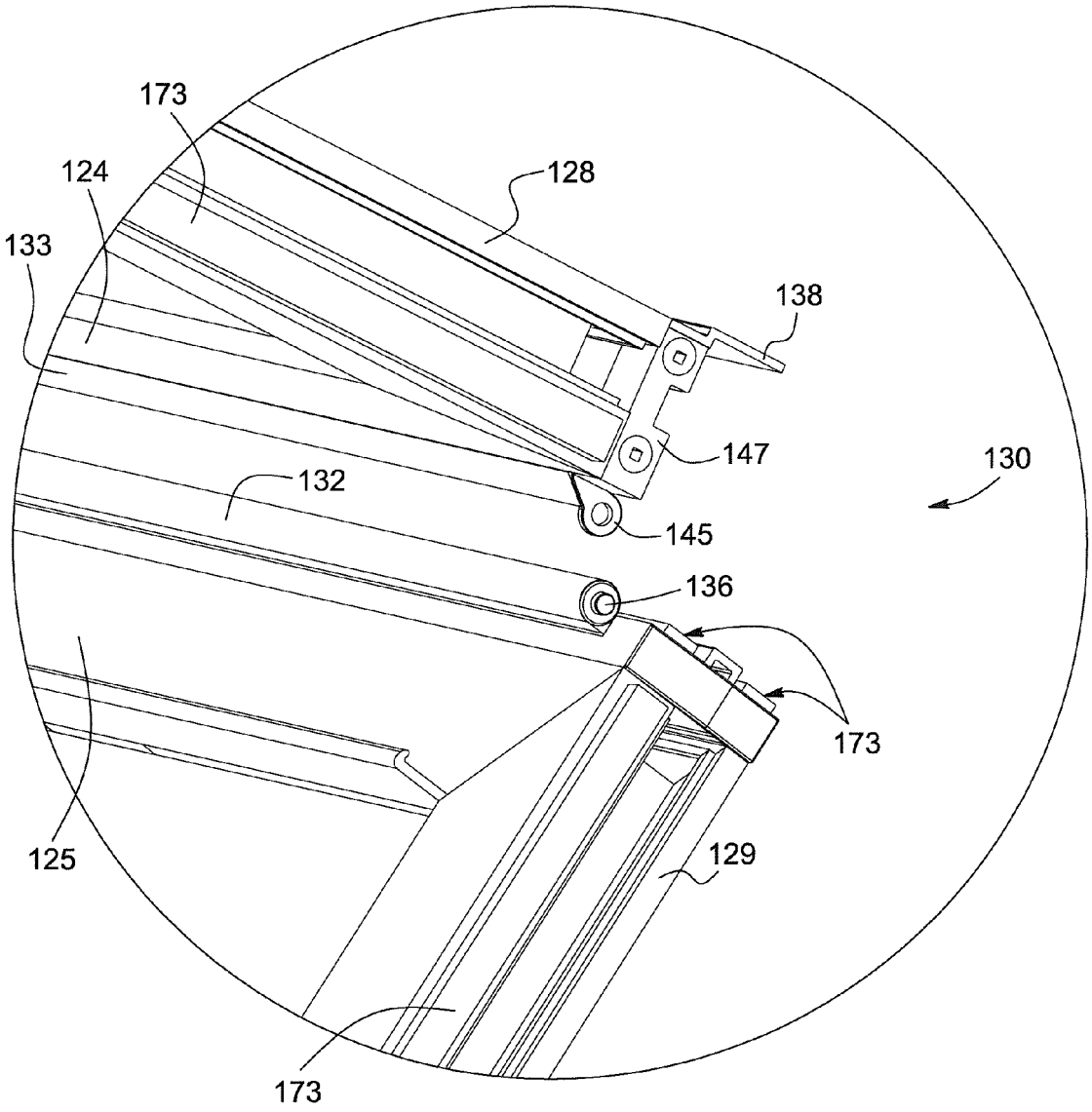
FIG. 10B is a close-up view of the sashes of FIG. 10 shown disconnected.

As best shown in FIGS. 10A and 10B, the hinge assembly 130 connects the bottom rail 124 of the upper sash 120 with the top rail 125 of the lower sash 122. These two rails 124,125 are also referred to as hingedly connected rails. The hinge assembly 130 includes a tube 132 which extends along the entire length of rail 125. The tube 132 can be hollow or full, or can be hollow only at its extremities, for receiving a retractable locking pin 136. The function of the retractable pin 136, which in this case is a plunger pin, will be explained later on in the description.

The hinge assembly 130 also includes a socket 133 sized to receive the tube 132, the socket 133 extending along the rails 124. The socket is a hollow which forms a holder for the tube 132. The upper and lower sashes 120,122 thus pivot about the tube 132 when the sashes 120,122 are moved between the extended closed configuration to the folded open configuration. The tube 132 and the socket 133 extend on the inner side of the top and bottom rails 125,124 so that the upper and lower sashes 120,122 can be closed correctly. The tube and socket can extend over the entire length of the top rail 125, creating a hinge assembly 130 that is discreet and sober, advantageously keeping the look of the window simple and lean from the interior. In other words, the aesthetic of the window, when looked from the inside, is uniform, and one looks at the window assembly 110, the eye is attracted by the view rather then the hinge assembly 130.

Figures 11, 11A:
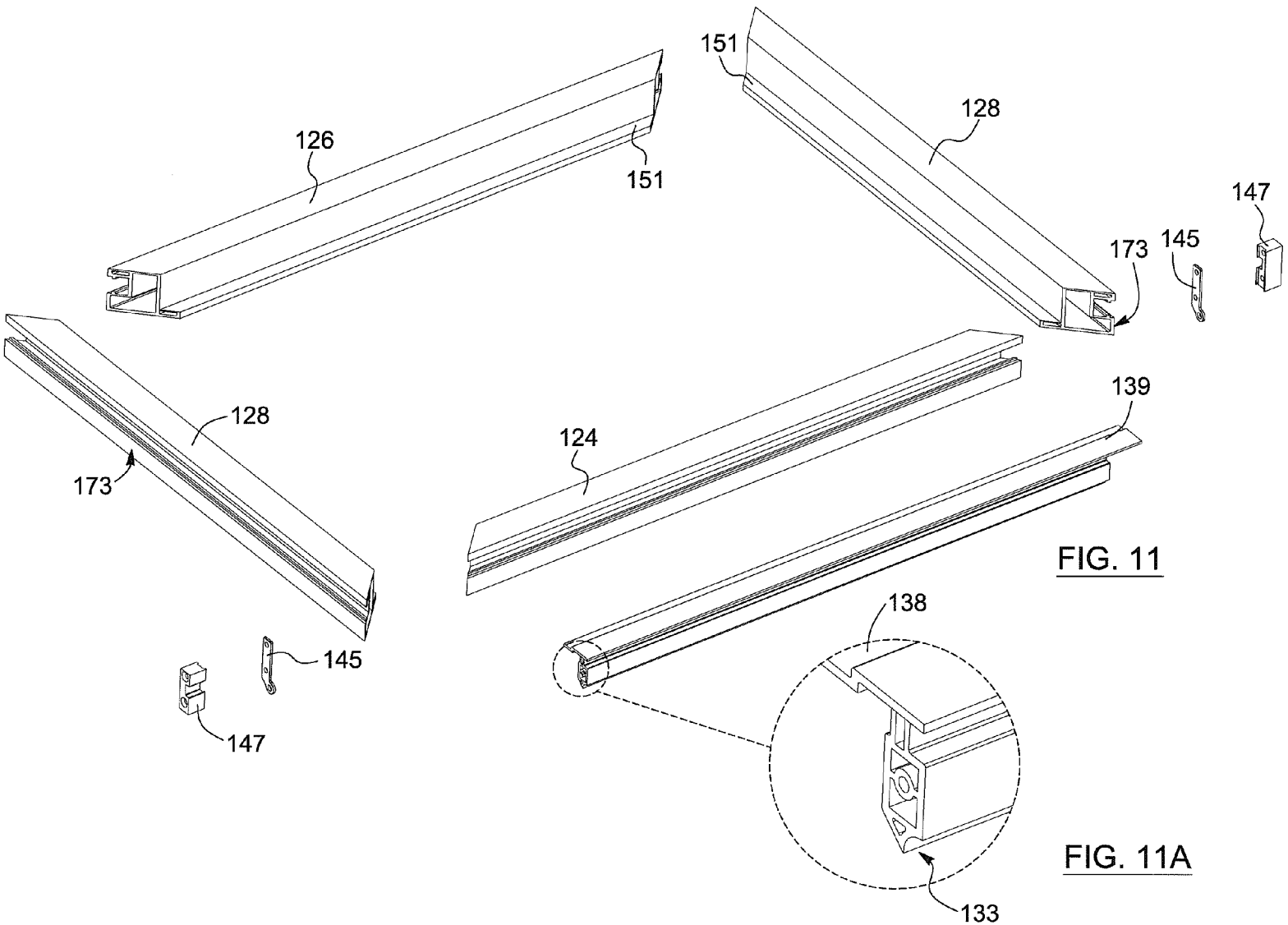
FIG. 11 is an exploded view of some of the elements of the upper sash and of the hinge assembly, from the window assembly of FIG. 8.
FIG. 11A is a close-up view of section 11A of FIG. 11.
Figure 13:
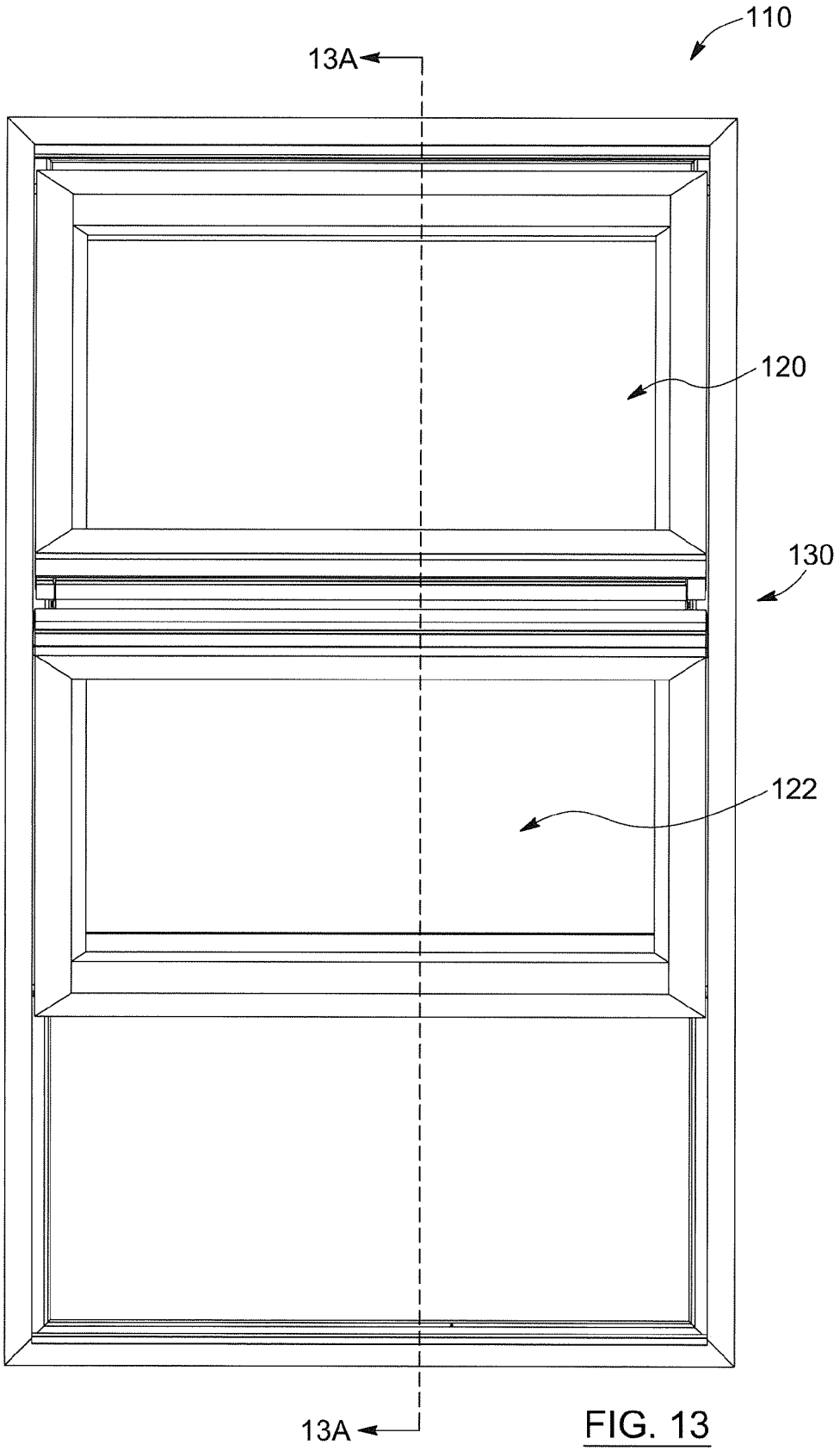
FIG. 13 is a front view of the window assembly of FIG. 8, in the open folded configuration.
Figure 13A:
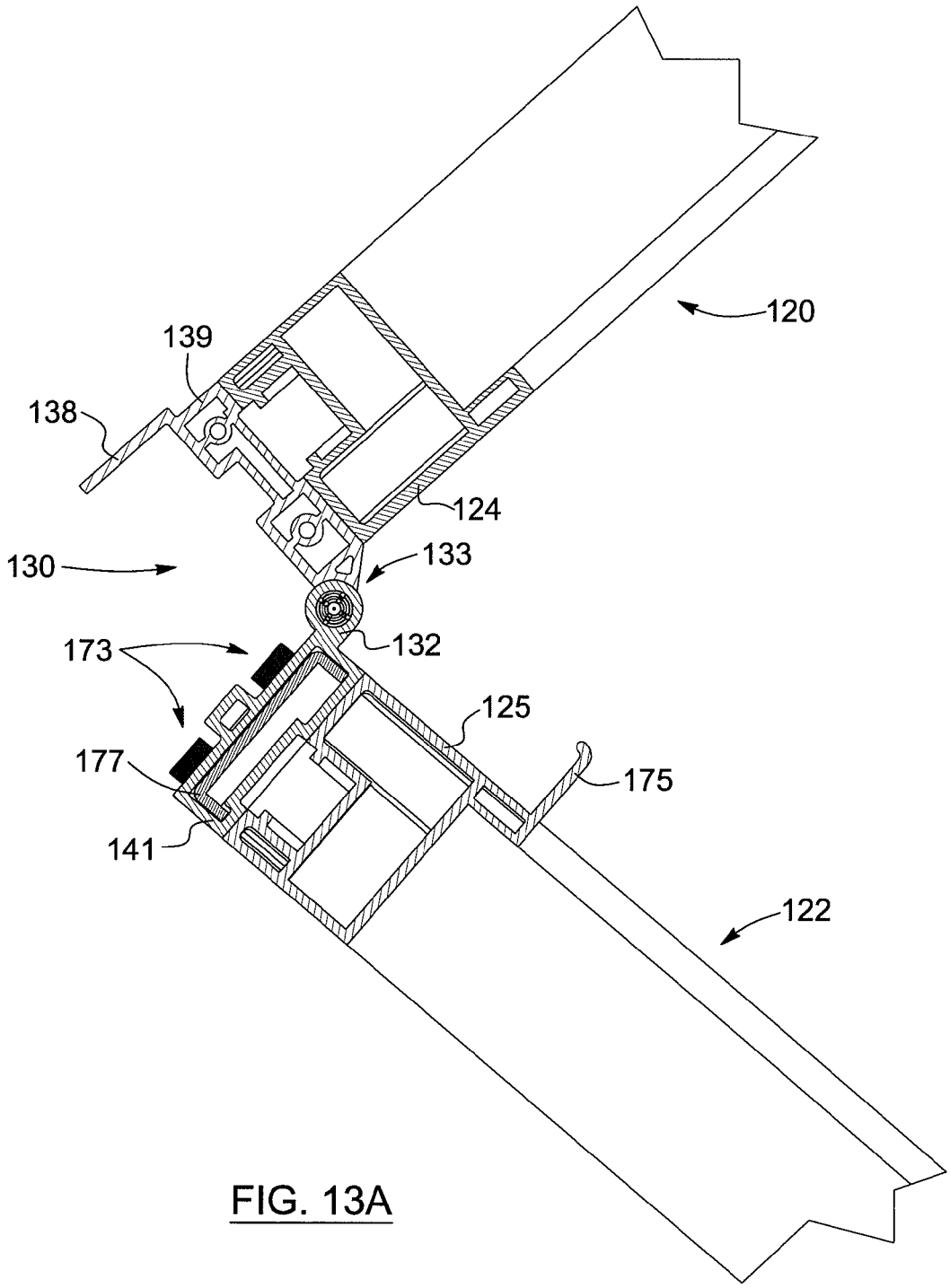
FIG. 13A is a partial cross-sectional view taken along line 13A-13A of FIG. 13.

Now referring to FIG. 10B, the hinge assembly 130 allows to reversibly connecting the lower sash 122 to the upper sash 120, because the socket 133 contacts the tube 132 only over a portion of the tube 132, thus allowing the tube 132 to be disengaged from the socket 133. FIGS. 11A and 13A also illustrate this characteristic of the socket 133. As it can be seen from these figures, the socket profile 133 extends or contacts the tube profile 132 over about a fourth of the circumference of the tube 132, and thus allows the tube 132 to be disengaged from the socket 133 easily.

Back to FIG. 10B, the hinge assembly 130 comprises locking pins 136 on both left and right sides of the tube 132, allowing to reversibly lock the tube 132 with the socket 133. When connected, the locking pins 136 protrude within apertures of hinge plates 145. In order to disconnect the lower and upper sashes 122,120, one needs to push the locking pins 136 inwardly on both sides of the tube 132, so as to disengage the locking pins 136 from the apertures of the hinge plates 145.

The configuration of the socket 133, receiving only a portion of the tube, combined with the use of push pins 136, advantageously allows disconnecting the lower and upper sashes 122,120 easily. This can be especially useful for cleaning the glass window panels, since it allows to access the external sides of the glazing, which are otherwise difficult to access, and most generally need to be accessed from the exterior. This characteristic is a great advantage over traditional double-hung windows, since the sashes do not need to be dismounted from the frame 112 to be cleaned.

FIGS. 11, 11A, 12 and 12A show the different components forming the frames of the sashes 120, 122, along with components of the hinge assembly 130.

Referring to FIG. 11, the hinge assembly 130 can include a first profiled section 139 which is connectible to the bottom rail 124 of the upper sash 120. In this embodiment, the first profiled section 139 includes the socket 133, which is best shown in FIG. 11A. Hinge blocks 147 and hinge plates 145 are connectible to the first profiled section 139, for example with screws (not shown). Of course, in other embodiments, it can be considered for the socket to be formed integrally on the bottom rail 124. The framing elements 124, 126, 128 can be provided with weather strips 173 on at least one of their lateral sides. While the framing elements 124, 126 and 128 of this embodiment are provided with a U-shaped channel on their lateral sides, in other embodiments of the frame, the framing elements 124, 126 and 128 can have a square or rectangular cross-section, without the U-shaped channel. This U-shaped channel can used for receiving window hardware, however, if not present, the window hardware, such as the pivoting and hinge assemblies, can be affixed directly on the lateral sides of the framing elements.

Figures 12, 12A:
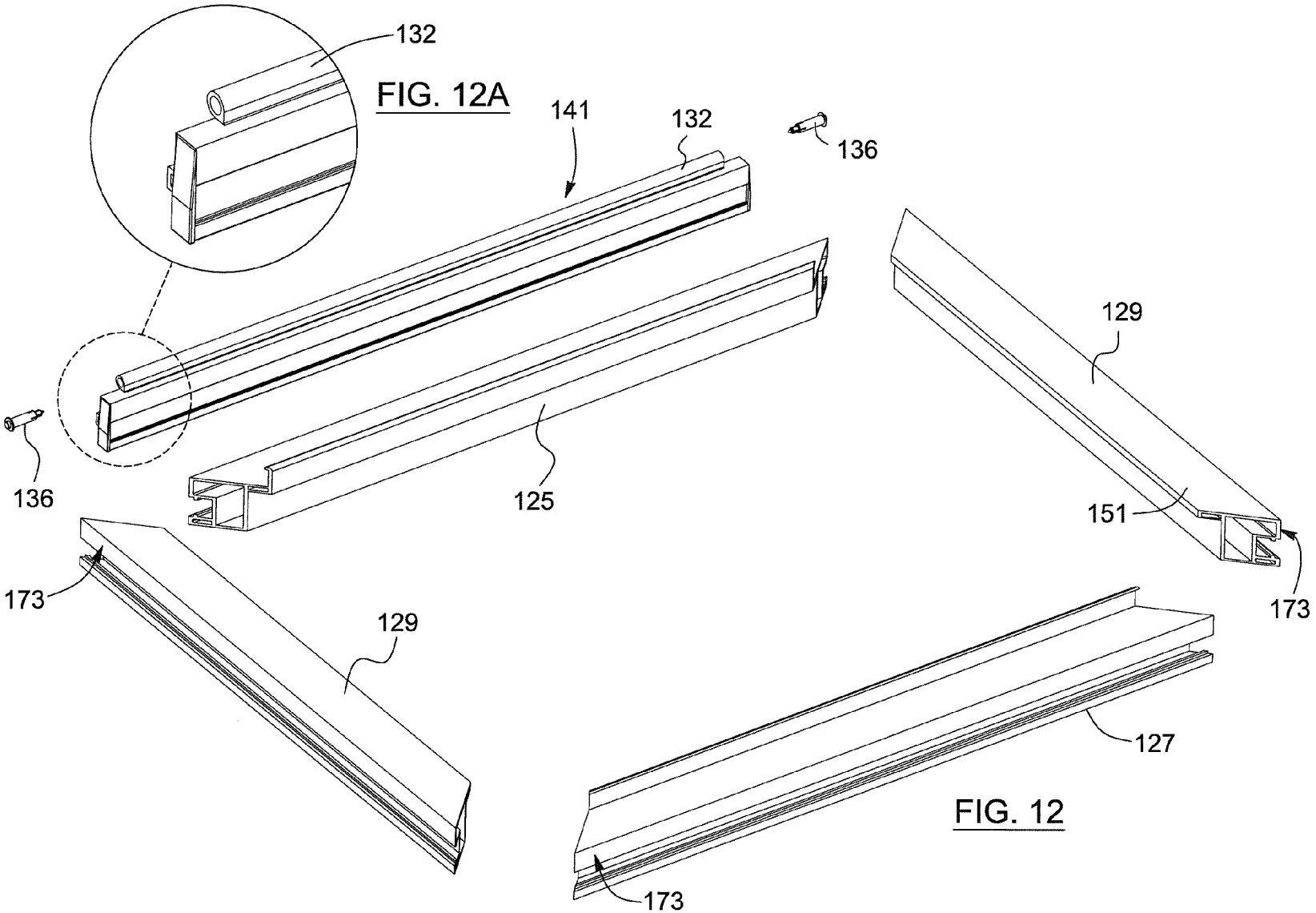
FIG. 12 is an exploded view of some of the elements of the lower sash and of the hinge assembly.
FIG. 12A is a close-up view of section 12A of FIG. 12.

As shown in FIG. 12, the hinge assembly 130 also includes a second profiled section 141 connectible to the top rail 125 of the lower sash 122. The second profiled section 141 includes the tube 132, which extends along the length of the second profiled section 141. An enlarged portion of the tube is shown in FIG. 12A. The locking pins 136 are insertable at both ends of the tube 132. Similarly, in other embodiments, it can be considered for the tube 132 to be formed integrally on the top rail 125. Weather strips 173 are also preferably provided on lateral sides of the framing elements 125, 127, 129. Yet still, the framing elements may not include the U-shaped channels on their lateral sides.

In order to increase insulation of the window assembly, frames of the upper and lower sashes 120, 122 can also be provided with weather strips 173. The weather strips are provided on the inner side of the framing elements such that when wind blows upon the sashes, the weather strips 173 are compressed between the sashes and the window frame 112.

Figure 13B:
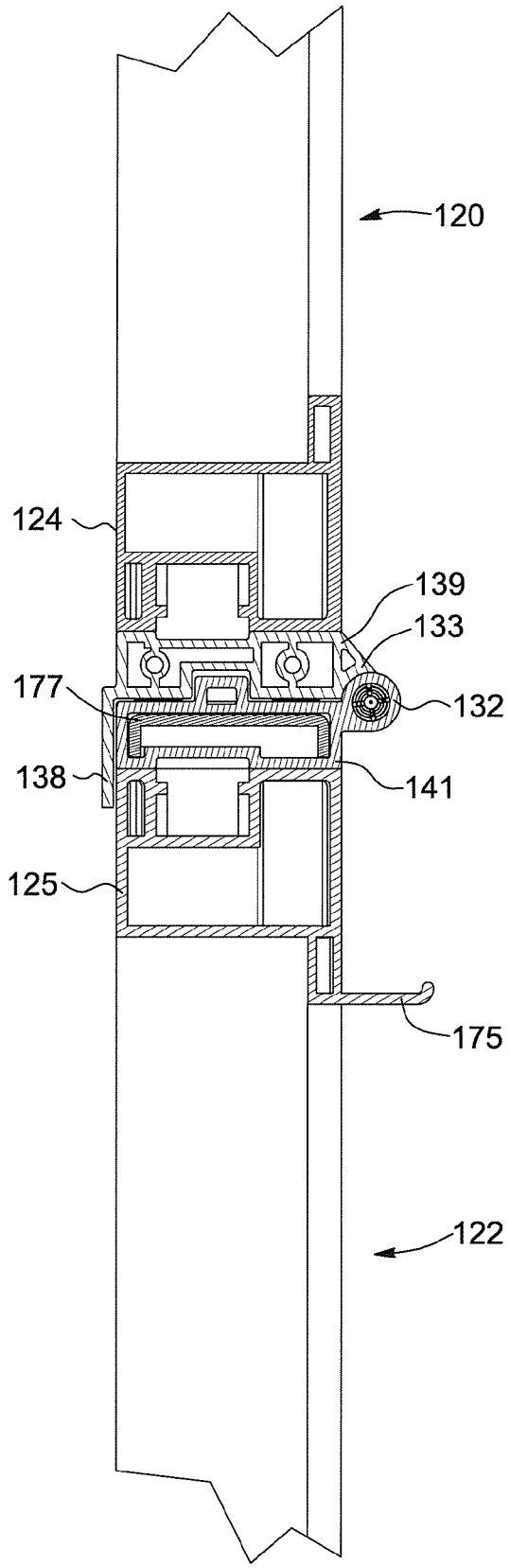
FIG. 13B is a partial cross-sectional view of the window assembly of FIG. 13, in an extended closed configuration.
Figure 14:
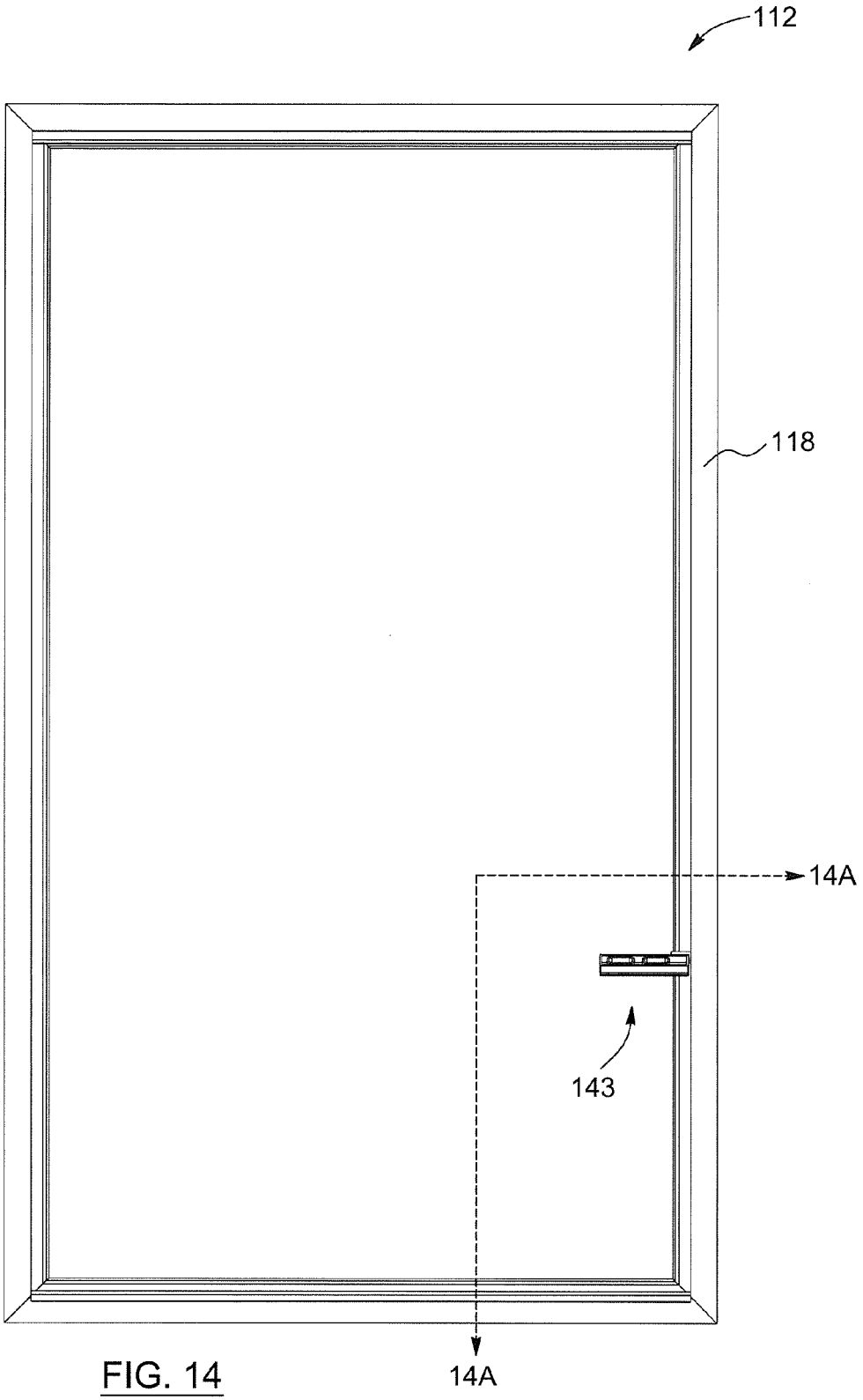
FIG. 14 is a front view of the window frame of the window assembly of FIG. 8, with some elements of a pivoting-and-sliding assembly mounted within one of the vertical jambs of the frame.

Now referring to FIGS. 13A, 13B and 14, the interrelation of the components forming the hinge assembly 130 in the open folded configuration and in the extended closed configuration can be better appreciated. In FIG. 13A, the inner side of the window assembly is on the right side, while the outer side is on the left side. In order to facilitate the opening and closing of the sashes 120,122 between the open folded configuration and the closed extended configuration, either the hingedly connected rails 124, 125 or the profiled sections 139,141 include a grabbing tab 175. The grabbing tab 175 can be provided near the hinge assembly, to facilitate the initial stage of lifting the sashes. One of the hingedly connected rails, or of first and second profiled sections, can be provided with a hiding tab 138, on the outer side of the window, for hiding the interstice between the sashes when closed, and also for hiding the hinge assembly 130. When looked at from the outside, in the closed configuration, the window has a simple and clean look, resembling a traditional double-hung window with a mullion. The window assembly can also include a reinforcement rod or plate 177, which can be made of steel, and located in either one of the top and bottom rails 124, 125, or one of the first and second profiled section 139, 141. In the case illustrated, the reinforcement element 177 is placed within the second profiled section 141. This reinforcement element 177 advantageously provides more strength to the window, in both positive and negative pressure environments.

Figure 14A:
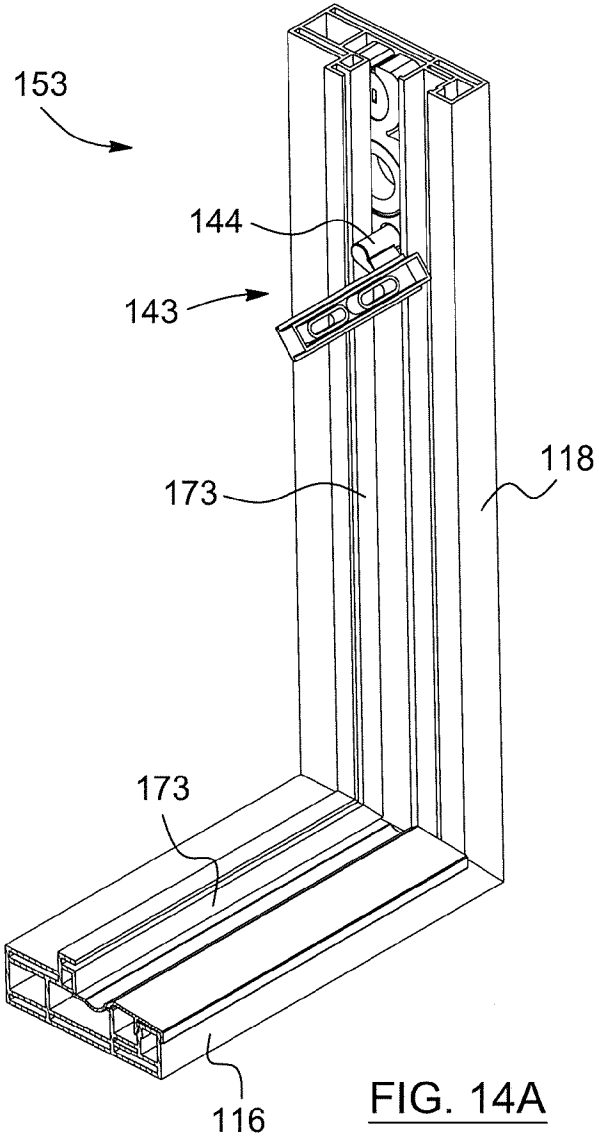
FIG. 14A is a partial cross-sectional view of the window frame of FIG. 14.

Referring to FIGS. 14 and 14A, some of the components of the pivoting-and-sliding assembly 153 are shown. The components shown are for one side of the window, the components of the other side of the window being identical to the ones illustrated. In FIG. 14A, components of the right side of the pivoting-and-sliding assembly 153 are shown, mounted to the vertical frame jambs 118 of the window frame 112. In FIG. 14A, the sashes 120, 122 are not shown to better illustrate the relation of the assembly 153 with the window frame 112. A pivot pin 144 is provided, and is operatively connectable to the right bottom corner of the lower sash 122. In this case, the pivot pin 144 is connectable to the lower sash 122, by a connecting element 143, insertable within a channel of the lower rail 127. The pivot pin 144 is rigidly connected to the connecting element 143. The pivot pin 144 is able to pivot within a sliding block 140. The sliding block 140 is inserted within a channel of the right vertical jamb, for sliding vertically within jamb 118. As shown, the sliding block 140 includes two apertures, so that the same block 140 can be used for the left and right sides of the window frame 112. When the sashes 120,122 are moved from the extended closed configuration to the folded open configuration, the pivot pin 144 pivots relative to the sliding block 140. Simultaneously, the sliding block 140 moves (or slides) upwardly within jamb 118, away from the frame sill 116. The pivot pin 144, the connecting element 143 and the sliding block 140 are also present on the left side of the assembly 110. The components forming the pivoting-and-sliding assembly thus allow the bottom corners of the lower sash 122 to pivot and slide within the window frame 112.

Figure 15:
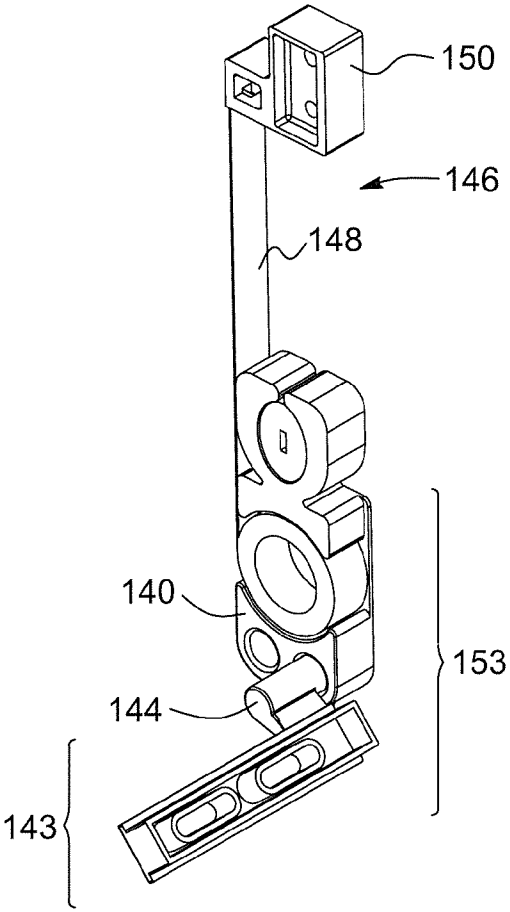
FIG. 15 is a perspective view of a sliding-and-pivoting assembly according to an embodiment for use in the window assembly of FIG. 8, including a balance device.

Referring to FIG. 15, the pivoting-and-sliding assembly 153 can include a balance device 146. The balance device 146 includes a retractable spring tape 148 having one end connected to the sliding block 140, and the other end connected to a balance retaining block 150. The balance retaining block 150 is affixable within a corresponding one of the vertical jambs 118 of the window frame 112, above the sliding block 140, such as at about two third of the height of vertical frame jamb 118, from the frame sill 116. The balance device 146 can thus support the weight of the lower sash 122 when moved upwardly. Of course, in other embodiments, it can be considered to include the rolled portion of the spring tape 148 within the balance retaining block 150 and the connecting end of the spring tape 148 within the sliding block 140. The balance device can also be apart from the pivoting-and-sliding assembly, although combining them in a single mechanism advantageously simplifies the configuration of the assembly 110.

Figure 16A:
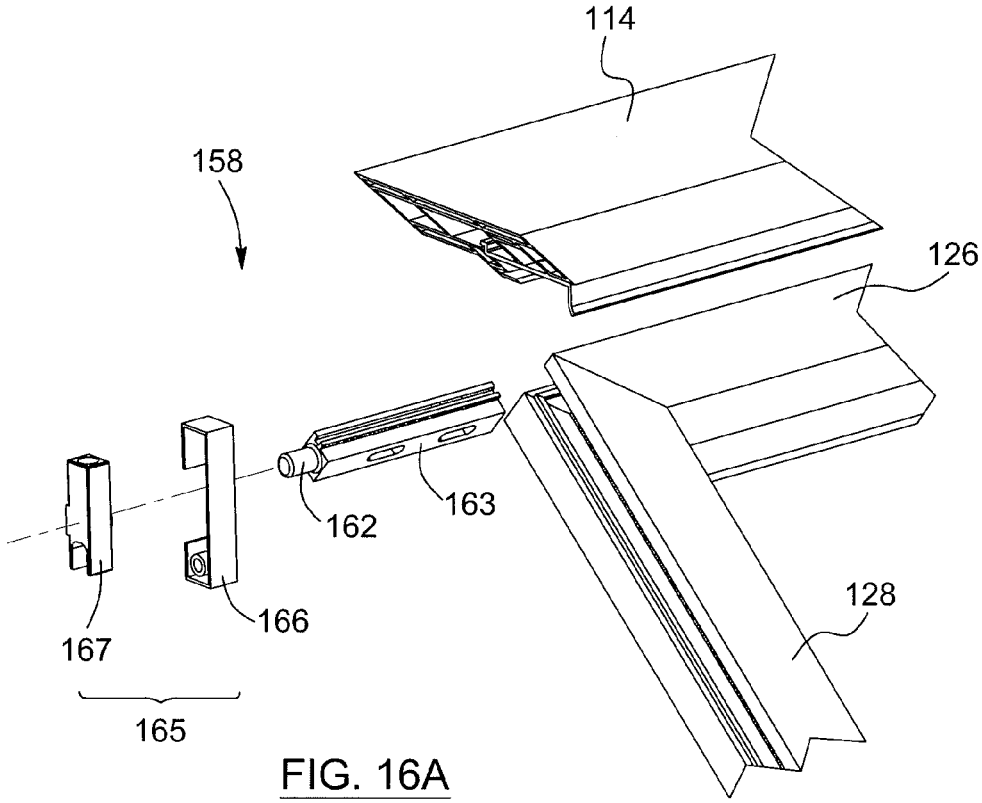
FIG. 16A is a partial exploded perspective view of the top section of the upper sash, of the window assembly of FIG. 8, with a pivoting assembly.
Figure 16B:
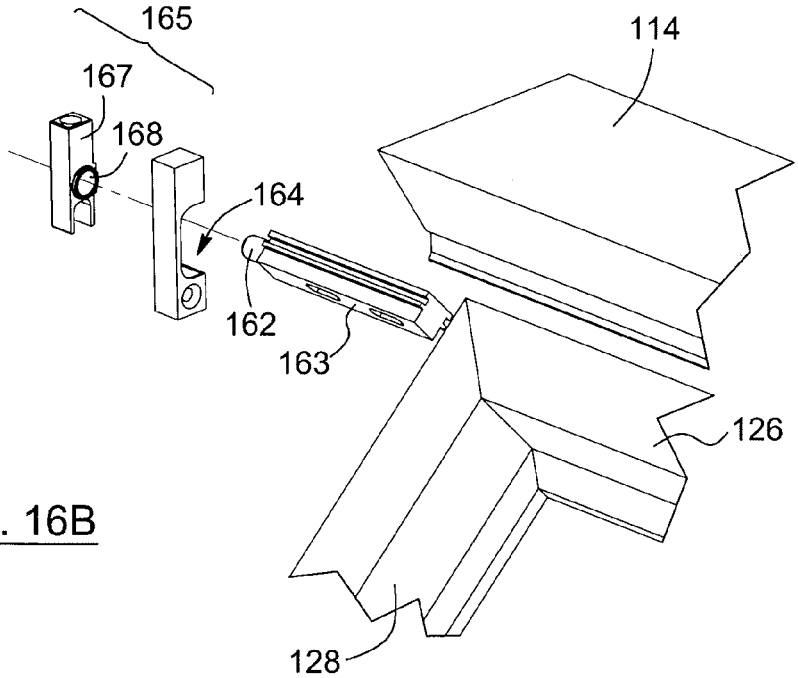
FIG. 16B is another perspective view of FIG. 16A.

Now referring to FIGS. 16A and 16B, components of the pivoting assembly 158 are shown, for one of the sides of the window assembly. The components shown are for connecting to the top left corner of upper sash 120. The components for connection with the right corner of the sash 120 are identical to the ones illustrated. A pivot pin 162 is provided, and is operatively connectable to the frame top section of the upper sash 120, such as to the top rail 126. In this case, the pivot pin 162 connects to the top rail 126 using a connecting element 163, but other types of connection can be considered. When in use, the pivot pin 162 is rigidly affixed to the top rail 126. A receiving device 165 is connectable the outer frame 112, for receiving the pivot pin 162. The receiving device includes an enclosure 166, which can be affixed within a channel of the vertical jamb 118, proximate to the frame header 114. This enclosure 166 includes a channel 164. The receiving device 165 also includes a receiving block 167, provided with an aperture 168, that is aligned with channel 164, for receiving the pivot pin 144. When the sashes 120,122 are moved from the extended closed configuration to the folded open configuration, the receiving block 167 slides slightly downwardly within enclosure 166, allowing the upper sash 120 to pivot without interfering with the frame header 114. In the present case, the enclosure 166 is affixed to the vertical jamb with a screw (not shown). However, it can be considered to provide the enclosure with a disengaging latch cooperating with the vertical jambs 118, in order to allow disengagement of the enclosure from the frame 112. Instead of permanently attaching the enclosure 166 to the vertical jamb 118, it is possible to use retractable locking pins 62 such as in the device shown in FIG. 7, allowing the entire receiving device 165 to slide vertically relative to the vertical frame jamb 118. Such disengaging latch device would allow the upper frame section of the upper sash 120 to slide downwardly within the window frame 112 in a folded open configuration. This disengaging latch device could be advantageous to clean the upper sash 120 by lowering it, or to improve ventilation by creating an opening between the top rail 126 of the upper sash 120 and the frame sill 116.

The window assembly 110 can comprise a locking mechanism 52 such as shown in FIG. 17, for locking the sashes 120,122 in the extended closed configuration. The locking mechanism 52 includes a retractable locking bar 54 insertable within one of the hingedly connected rails 124,125. Two lock-receiving elements 53, each affixed to a corresponding one of the vertical jambs 118, are also provided. These lock-receiving elements 53 include apertures to receive tips of the retractable locking bar 54. A cam 58 cooperating with the retractable locking bar 54, allows to retract the locking bar 54 from the lock receiving elements 56 in an unlocking position, and to extend the locking bar 54 within the lock receiving elements 56 when in a locking position. Of course, other locking mechanisms can be considered, such as to use two blocks at each side (left and right) of either one of the upper or lower sashes 120,122, such as near the hinge mechanism.

As can be appreciated, the present window assembly offers several advantages over double-hung window assemblies.

It has increased insulation properties since the weather strips can be positioned within channels of the window frame 112 or channel of the sash frames 120,122, such that they are compressed when wind blows upon the window. Better insulation can also be obtained by using more than one glass pane 131 for each sashes, while keeping the force required to move the sashes 120,122 in the folded open configuration relatively low. In a typical double-hung window assembly, when more glass panels are used within a sash, the force required to lift up the lower sashes is proportionally increased. Balance devices with more force thus must be used, which are also more expensive. Advantageously, this situation is avoided with the present window assembly, mainly because upon lifting the sashes, the weight of the sashes 120,122 is moved away from the window frame 112, creating a level effect.

Another advantage of the present window assembly is obviously the increased ventilation. When opened, outside air can penetrate through almost the entire frame opening 111.

Yet another advantage of this window assembly 110 resides in its clean and simple look, resembling a traditional double-hung window when in the closed configuration. While many types of hinges can be used as a hinge assembly 130, an assembly including an elongated tube and socket connection provides an uncluttered look, even when folded. The hinge assembly 130 described also advantageously allows a user to easily disconnect the upper and lower sashes 120,122, thereby facilitating cleaning operations.

Of course, numerous modifications could be made to the embodiments above without departing from the scope of the claims.

The invention claimed is:

1. A window assembly comprising:

an upright window frame defining a frame opening, the window frame including a frame header, a frame sill, and a pair of vertical frame jambs extending from the frame header to the frame sill;

an upper sash and a lower sash mounted in said window frame, each of said sashes including a sash frame and a panel, each sash frame including a top rail, a bottom rail and two vertical stiles extending from the top to the bottom rail, for retaining the panel;

the frame of the upper sash having a top section and a bottom section, the top section being pivotally mounted to the window frame, allowing the upper sash to pivot about its top rail;

the frame of the lower sash having a top section and a bottom section, the bottom section being pivotally mounted to the window frame, allowing the bottom sash to pivot about its bottom rail;

at least one of the upper and lower sashes being a slidable sash, the frame of the at least one slidable sash being also slidably mounted to the frame jambs of the window frame, allowing the at least one slidable sash to slide vertically within the window frame;

a hinge assembly hingedly connecting the bottom rail of the upper sash with the top rail of the lower sash, said rails being also referred to as hingedly connected rails, the hinge assembly comprising:

a single elongated tube extending along the length of one of the frame bottom section of the upper sash and the frame top section of the lower sash; and a single elongated socket sized to receive said tube, the socket extending along the other one of the frame bottom section of the upper sash and the frame top section of the lower sash, the socket contacting the tube only over a circumferential portion of the tube;

a removable locking pin for reversibly locking the tube and the socket of the respective hingedly connected rails;

the upper and lower sashes being movable between an extended closed configuration and a folded open configuration, wherein in the extended closed configuration, the upper and lower sashes extend within the window frame, closing the frame opening, and in the folded open configuration, one of said at least one slidable sash is brought towards one of the upper and lower sashes and the hinge assembly points outwardly from the window frame, the upper and lower sashes pivoting about the tube when moved between the extended closed configuration and folded open configuration; and a retaining device operatively connectable to one of said at least one slidable sash and to said window frame, for retaining the one of said at least one slidable sash when the upper and lower sashes are in the folded open configuration.

wherein the tube is capable of disengaging from the socket, when the lower and upper sashes are in the folded open configuration.

2. The window assembly according to claim 1, wherein the hinge assembly includes a first profiled section connected to the bottom rail of the upper sash, and a second profiled section connected to the top rail of the lower sash, the first profiled section including the socket, and the second profiled section including the tube.

3. The window assembly according to claim 1, comprising a locking mechanism for locking the sashes in the extended closed configuration, the locking mechanism including:

a retractable locking bar inserted within one of the hingedly connected rails; two lock-receiving elements, each affixed to a corresponding one of the vertical jambs of the window frame; and a cam cooperating with the locking bar, for retracting the locking bar from the lock-receiving elements when in an unlocking position, and for extending the locking bar in the lock-receiving elements when in a locking position.

4. The window assembly according to claim 1, wherein the window frame has an inner side for facing inwardly of a building and an outer side for facing outwardly of the building, one of the hingedly connected rails being provided with a grabbing tab on the inner side of the assembly, for facilitating closing and opening of the upper and lower sashes from the open configuration to the closed configuration or vice-versa.

5. The window assembly according to claim 1, wherein one of the hingedly connected rails is provided with a hiding tab on an outer side of the window frame, for hiding the hinge assembly.

6. The window assembly according to claim 1, wherein the at least one slidable sash comprises the upper and lower sashes, the window assembly comprising two pivoting-and-sliding assemblies for pivotally and slidably connecting the frame bottom section of the lower sash to the vertical frame jambs of the window frame, and the frame upper section of the upper sash to the vertical frame jambs of the window frame, respectively.

7. The window assembly according to claim 1, wherein the at least one slidable sash is the lower sash, the window assembly comprising:

a pivoting assembly for pivotally connecting the frame top section of the upper sash to the vertical frame jambs of the window frame, proximate the frame header; and a pivoting-and-sliding assembly for pivotally and slidably connecting the frame lower section of the lower sash to the vertical frame jambs of the window frame.

8. The window assembly according to claim 7, wherein each of the enclosures are removably affixed to the corresponding vertical jamb by a disengaging latch device cooperating with said enclosure and said corresponding vertical jamb, said device disengaging the enclosure from the frame when operated, thereby allowing the frame upper section of the upper sash to slide downwardly within the window frame, when the upper and lower sashes are in the folded open configuration.

9. The window assembly according to claim 1, comprising at least one balance device located along one of the vertical jambs of the frame, for supporting the weight of the at least one slidable sash.

10. The window assembly according to claim 9, wherein the pivoting assembly comprises:

two pivot pins, operatively connected to left and right sides of the frame top section of the upper sash, respectively, and two receiving devices, for receiving a corresponding one of the pivot pins, each receiving device including an enclosure affixable to a corresponding one of the vertical jambs, proximate the frame header, the enclosure including a channel, and a receiving block adapted to slide within the enclosure, the block being provided with an aperture aligned with the channel of the enclosure, and configured to receive a corresponding one of the pivot pins, such that when the upper and lower sashes are moved from the extended closed configuration to the folded open configuration, the receiving blocks slide slightly downwardly within their respective enclosures, allowing the upper sash to pivot without interference with the frame header.

11. The window assembly according to claim 10, wherein the pivoting-and-sliding assembly comprises a balance device, the balance device including a retractable spring tape having one end connected to one of the sliding blocks, and the other end connected to a balance retaining block, the balance retaining block being affixed within a corresponding one of the vertical jambs of the window frame, above said one of the sliding blocks, the balance device thereby supporting the weight of the lower sash when moved upwardly.

12. The window assembly according to claim 9, wherein the pivoting-and-sliding assembly comprises:

two pivot pins, operatively connected to left and right sides of the frame lower section of the lower sash, respectively, and two sliding blocks, each slidably mounted to a corresponding one of the vertical jambs, each sliding block provided with an aperture for receiving a corresponding one of the pivot pins, such that when the upper and lower sashes are moved from the extend closed configuration to the folded open configuration, the pivot pins pivot within the respective sliding blocks, and the sliding blocks move upwardly within the respective vertical jambs, away from the frame sill, allowing the frame bottom section of the lower sash to pivot and slide within the window frame.

13. The window assembly according to claim 12, wherein the retaining device corresponds to the balance device.

14. A window assembly comprising:

an upright window frame defining a frame opening, the window frame including a frame header, a frame sill, and a pair of vertical frame jambs extending from the frame header to the frame sill, an upper sash and a lower sash mounted in said window frame, each of said sashes including a top rail, a bottom rail and two vertical stiles extending from the top to the bottom rail, for retaining a panel;

the upper sash having a top section and a bottom section, the top section being pivotally mounted to the window frame, near the frame header, allowing the upper sash to pivot about its top rail;

the lower sash having a top section and a bottom section, the bottom section being pivotally mounted to the window frame, near the frame sill, allowing the bottom sash to pivot about its bottom rail, the lower sash being also slidably mounted to the frame jambs of the window frame, allowing the bottom section of the lower sash to slide vertically within the window frame;

a hinge assembly for hingedly connecting the bottom rail of the upper sash with the top rail of the lower sash, said rails being also referred to as hingedly connected rails, the hinge assembly comprising a single elongated tube extending along the length of one of said hingedly rails, and a single elongated socket sized to receive said tube, the socket profile extending along the other one of said hingedly connected rails; the socket contacting the tube only over a circumferential portion of the tube;

a removable locking pin for reversibly locking the tube and the socket of the respective hingedly connected rails;

the upper and lower sashes being movable between an extended closed configuration and a folded open configuration, wherein in the extended closed configuration, the upper and lower sashes extend within the window frame, closing the frame opening, and in the folded open configuration, the lower sash is raised, the lower and upper sashes being pivoted about the tube, the hinge assembly pointing outwardly from the window frame; and a retaining device operatively connectable to the lower sash and to the window frame, for retaining the lower sash in a raised position when the sashes are in the folded open configuration;

wherein the tube is capable of disengaging the socket, when the lower and upper sashes are in the folded open configuration.

15. The window assembly according to claim 1, wherein the hinge assembly further comprises at least one hinge plate affixed to at least one corresponding end of said socket, each one of said at least one hinge plate including an aperture, said at least one hinge plate and said tube being adapted to receive said removable locking pin to lock said tube with said socket through said at least one hinge plate.

16. The window assembly according to claim 15, wherein said removable locking pin is a retractable push pin provided in said tube which includes a retractable section capable of extending for insertion in said aperture of said hinge plate of said socket to lock the hinge assembly and capable of retracting to free the aperture of the hinge plate for disengaging the tube and the socket.

* * * * *

UNITED STATES PATENT AND TRADEMARK OFFICE

CERTIFICATE OF CORRECTION

PATENT NO. : 9,080,379 B2
APPLICATION NO. : 13/297406
DATED : July 14, 2015
INVENTOR(S) : Christian Guillemette It is certified that error appears in the above-identified patent and that said Letters Patent is hereby corrected as shown below:

In the claims

Claim 1, column 15, line 58, the (.) after the word "configuration" should be replaced by a (;).

Signed and Sealed this
Fifteenth Day of December, 2015

Michelle K. Lee

Michelle K. Lee
*Director of the United States Patent and Trademark Office*